US008833844B2

(12) United States Patent
LaPointe et al.

(10) Patent No.: US 8,833,844 B2
(45) Date of Patent: Sep. 16, 2014

(54) POWER ACTUATED GLIDER FURNITURE MEMBER

(75) Inventors: Larry P. LaPointe, Temperance, MI (US); Chad E. Adams, Perrysburg, OH (US); Eric B. Harwood, Toledo, OH (US); Richard E. Marshall, Monroe, MI (US); Michael R. Mero, Jr., Monroe, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 435 days.

(21) Appl. No.: 12/759,267

(22) Filed: Apr. 13, 2010

(65) Prior Publication Data

US 2011/0248546 A1 Oct. 13, 2011

(51) Int. Cl.
*A47C 1/031* (2006.01)
*A47C 1/0355* (2013.01)

(52) U.S. Cl.
CPC ..... *A47C 1/0355* (2013.01); *Y10S 297/07* (2013.01)
USPC ..... 297/85 M; 297/259.2; 297/DIG. 7

(58) Field of Classification Search
USPC ..... 297/85 M, 259.2, DIG. 7
See application file for complete search history.

(56) References Cited

U.S. PATENT DOCUMENTS 463,863 A * 11/1891 Johnson ..... 297/279
766,836 A * 8/1904 Miller et al. ..... 297/282
2,302,387 A 11/1942 Greeno et al.
2,683,481 A 7/1954 Lorenz
3,016,264 A * 1/1962 Hughes ..... 297/69
3,093,409 A * 6/1963 Fletcher ..... 297/89
4,154,475 A 5/1979 Shoemaker et al.
4,226,468 A * 10/1980 Johnson ..... 297/84
4,536,029 A 8/1985 Rogers, Jr.
4,544,201 A * 10/1985 Rogers, Jr. ..... 297/259.2
4,577,902 A * 3/1986 Crum ..... 297/85 L
4,591,205 A 5/1986 James
4,662,673 A * 5/1987 Crum ..... 297/68
4,674,794 A * 6/1987 Pine ..... 297/85 M
4,681,365 A * 7/1987 Pine ..... 297/85 M
4,700,920 A 10/1987 Horn
5,186,518 A * 2/1993 Pine ..... 297/85 L
5,326,153 A 7/1994 Muffi
5,427,433 A 6/1995 Holobaugh, Jr.
5,730,494 A * 3/1998 LaPointe et al. ..... 297/330
5,765,913 A 6/1998 LaPointe et al.
5,795,021 A * 8/1998 Rogers ..... 297/281
5,795,028 A 8/1998 Dussia, Jr. et al.
5,857,744 A 1/1999 LaPointe et al.
5,890,765 A 4/1999 LaPointe et al.
5,975,627 A * 11/1999 LaPointe et al. ..... 297/68
5,992,930 A * 11/1999 LaPointe et al. ..... 297/68

(Continued)

*Primary Examiner* — David E Allred
(74) *Attorney, Agent, or Firm* — Harness, Dickey & Pierce, P.L.C.

(57) ABSTRACT

A glider furniture member adapted for electrically powered operation includes a frame having a plurality of upright posts. A plurality of links are individually rotatably connected to individual ones of the plurality of upright posts. An actuation mechanism suspended from the upright posts at rotatably connected free ends of each of the links permits forward and rearward gliding motions of the actuation mechanism. The actuation mechanism includes a leg rest assembly movable between a fully retracted and a fully extended position inclusive. An electrically powered drive assembly connected to the actuation mechanism rotates the leg rest assembly and the seat back member independently of an occupant induced force operating to move the actuation mechanism in the forward and rearward gliding motions.

19 Claims, 20 Drawing Sheets

(56) References Cited

U.S. PATENT DOCUMENTS

| | | | | | |
|---|---|---|---|---|---|
| 5,992,931 | A * | 11/1999 | LaPointe et al. | 297/85 M |
| 6,059,367 | A * | 5/2000 | Rogers | 297/423.1 |
| 6,120,095 | A * | 9/2000 | Rogers | 297/273 |
| 6,145,924 | A * | 11/2000 | Mero et al. | 297/68 |
| 6,318,803 | B1 * | 11/2001 | Garland | 297/344.11 |
| 6,612,651 | B1 * | 9/2003 | Garland | 297/344.11 |
| 6,899,393 | B2 * | 5/2005 | Garland | 297/344.11 |
| 7,083,235 | B2 * | 8/2006 | Grimm et al. | 297/423.21 |
| 7,543,893 | B2 * | 6/2009 | LaPointe | 297/463.1 |
| 7,828,756 | B2 * | 11/2010 | Kamba et al. | 601/98 |
| 8,016,348 | B2 * | 9/2011 | Hoffman et al. | 297/85 M |
| 8,113,574 | B2 * | 2/2012 | Hoffman et al. | 297/85 M |
| 8,123,288 | B2 * | 2/2012 | Murphy et al. | 297/85 R |
| 8,297,693 | B2 * | 10/2012 | Hoffman et al. | 297/85 M |
| 8,366,188 | B2 * | 2/2013 | Adams et al. | 297/85 R |
| 8,366,193 | B2 * | 2/2013 | Lin | 297/261.1 |
| 8,398,169 | B2 * | 3/2013 | Lapointe | 297/260.2 |
| 8,419,122 | B2 * | 4/2013 | Lawson et al. | 297/85 M |
| 8,459,733 | B2 * | 6/2013 | Hoffman et al. | 297/85 M |
| 2007/0063559 | A1 * | 3/2007 | Chouinard et al. | 297/281 |
| 2010/0127555 | A1 * | 5/2010 | Hoffman et al. | 297/85 M |
| 2011/0049963 | A1 * | 3/2011 | Shih | 297/85 M |
| 2011/0248545 | A1 * | 10/2011 | Lapointe et al. | 297/85 M |
| 2011/0248547 | A1 * | 10/2011 | Lapointe et al. | 297/85 R |
| 2012/0286557 | A1 * | 11/2012 | Hoffman et al. | 297/85 M |

* cited by examiner

POWER ACTUATED GLIDER FURNITURE MEMBER

FIELD

The present disclosure relates to furniture members having forward and rearward gliding capability.

BACKGROUND

This section provides background information related to the present disclosure which is not necessarily prior art.

Conventionally, reclining articles of furniture (i.e., chairs, sofas, loveseats, and the like) require a mechanism to bias a leg rest assembly in the extended and stowed positions and to move a seat back member from an upright to a fully reclined position. Most reclining furniture members include an upholstered frame supported from a stationary base assembly. For example, known combination platform reclining chairs permit reclining movement of the seat assembly and actuation of the leg rest assembly independently of the seat back member. The leg rest assembly is operably coupled to a drive mechanism to permit the seat occupant to selectively move the leg rest assembly between its normally retracted (i.e., "stowed") and elevated (i.e., "extended") positions. The drive mechanism is manually-operated and includes a handle which, when rotated by the seat occupant, causes concurrent rotation of a drive rod for extending or retracting the leg rest assembly.

Furniture member mechanisms are known which suspend the mechanism from posts upwardly extending from a base frame using elongated linkage members so the mechanism and thereby the furniture member can "glide" forward and backward from a neutral position by force induced by the furniture member occupant. The gliding motion is distinct from "rocking" mechanisms in that in rocking mechanisms a biasing device or assembly on opposite sides of the furniture member positioned between a frame member and the mechanism directly supports the mechanism from below the mechanism. This substantially limits forward and rearward motion with respect to an axis of rotation defined by the biasing device. Because of the length of the supporting linkage members, the "glide" mechanism provides increased forward and rearward displacement compared to the rocking mechanism.

SUMMARY

This section provides a general summary of the disclosure, and is not a comprehensive disclosure of its full scope or all of its features.

According to several embodiments of the present disclosure, a glider furniture member adapted for electrically powered operation includes a frame and an actuation mechanism rotatably suspended from the frame permitting forward and rearward gliding motions of the actuation mechanism. The actuation mechanism includes a leg rest assembly movable between a fully retracted and a fully extended position inclusive, and a seat back member movable between a fully upright and a fully reclined position inclusive. An electrically powered drive assembly connected to the actuation mechanism operates to rotate the leg rest assembly and the seat back member independently of an occupant induced force operating to move the actuation mechanism in the forward and rearward gliding motions.

According to further embodiments, a glider furniture member adapted for electrically powered operation includes a frame having a plurality of upright posts. A plurality of links are individually rotatably connected to individual ones of the plurality of upright posts. An actuation mechanism suspended from the upright posts at rotatably connected free ends of each of the links permits forward and rearward gliding motions of the actuation mechanism. The actuation mechanism includes a leg rest assembly movable between a fully retracted and a fully extended position inclusive. An electrically powered drive assembly connected to the actuation mechanism operates to rotate the leg rest assembly and the seat back member independently of an occupant induced force operating to move the actuation mechanism in the forward and rearward gliding motions.

According to other embodiments, a glider furniture member adapted for electrically powered operation includes a frame having two posts connected to each of a first and a second longitudinal frame member and extending upwardly therefrom. Four links are each rotatably connected to one of the posts at a first end. First and second support structures are included, the first support structure rotatably connected to the links connected to the first longitudinal frame member, and the second support structure rotatably connected to the links connected to the second longitudinal frame member. An actuation mechanism is fixedly connected to the first and second support structures and thereby suspended from the upright posts by the links, permitting forward and rearward gliding motions of the actuation mechanism. The actuation mechanism includes a leg rest assembly, a seat back member, and an electrically powered drive assembly operating to rotate the leg rest assembly and the seat back member independently of an occupant induced force operating to move the actuation mechanism in the forward and rearward gliding motions.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
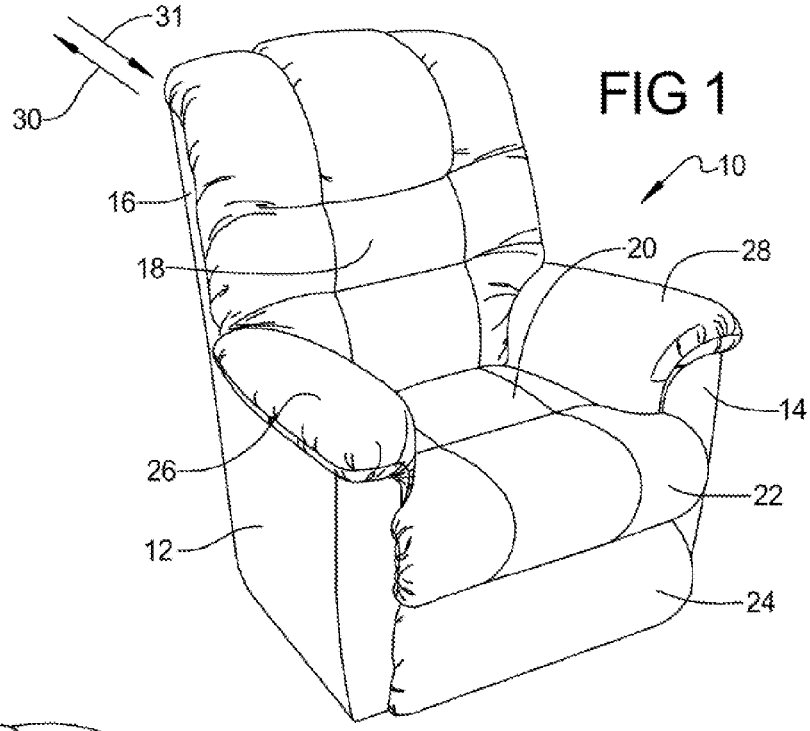
FIG. 1 is a front right perspective view of a power actuated glider furniture member of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring generally to FIG. 1, a furniture member 10 depicted as a chair includes first and second sides 12, 14 and an occupant seat back 16 covered with a seat back cushion assembly 18. An occupant support member 20 is suspended between the first and second sides 12, 14 and a padded leg support 22 is also provided. A padded, extendable leg rest assembly 24 is also provided. First and second arm rest pads 26, 28 can be used to cover the upper surfaces of the first and second sides 12, 14 respectively. From the leg rest assembly 24 stowed or retracted position shown, seat back 16 is powered to recline or rotate with respect to a seat back recline arc of rotation 30. Seat back 16 rotates about a seat back reclining arc of rotation 30 only after leg rest assembly 24 reaches a fully extended position shown and described with reference to FIGS. 8 and 11. Seat back 16 returns to the upright position shown about a seat back forward arc of rotation 31 directed opposite to seat back reclining arc of rotation 30 when a command is given by the occupant. Thereafter, the seat back 16 first rotates back to the upright position sequentially followed by return of leg rest assembly 24 from a fully extended position to the fully retracted position shown. In the embodiment shown, furniture member 10 is depicted as a chair however the present teachings are not limited to chairs. Furniture member 10 can also be any of a plurality of furniture members, including, but not limited to single or multiple person furniture members, sofas, sectional members and/or loveseats.

Figure 2:
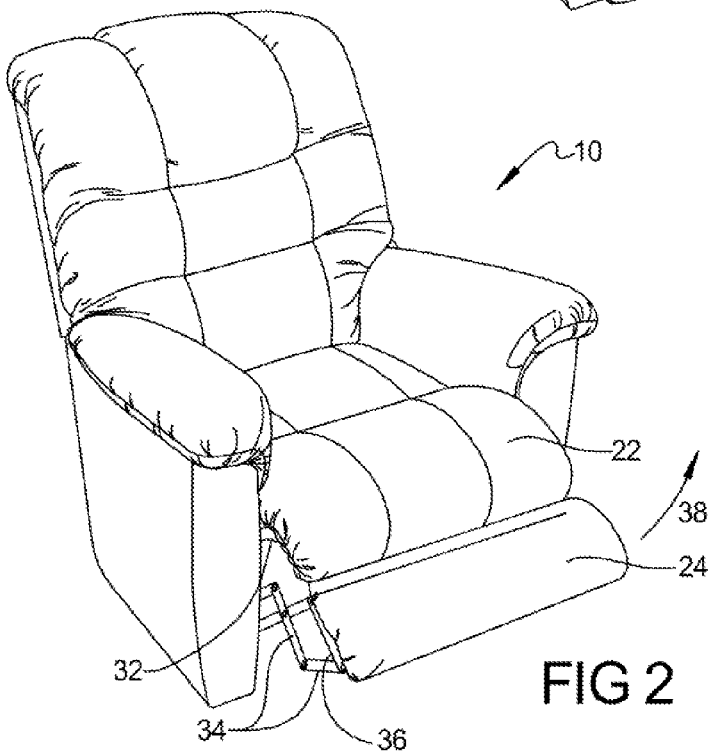
FIG. 2 is the front right perspective view of FIG. 1 further showing a leg rest assembly in an extended position.

Referring generally to FIG. 2 and again to FIG. 1, an actuation mechanism 32 (shown only partially in this view) can be actuated by the occupant to direct the repositioning of leg rest assembly 24 from the stowed position (shown in FIG. 1) to an extended position (a partially extended position is shown). Actuation mechanism 32 supports and permits both extension and retraction of leg rest assembly 24, as well as rotation of seat back 16. More specifically, actuation mechanism 32 includes first and second pantograph linkage sets 34, 35 (second pantograph linkage set 35 is not visible in this view) which are linked to leg rest assembly 24 using first and second leg rest support arms 36, 37 (only first leg rest support arm 36 is visible in this view). Leg rest assembly 24 can be moved from the fully retracted position (shown in FIG. 1) to the extended position by motion of the leg rest assembly 24 about a leg rest extension arc 38. It will be apparent that rotation of leg rest assembly 24 in an opposite direction from extension arc 38 will return the leg rest assembly 24 to the retracted position.

Figure 3:
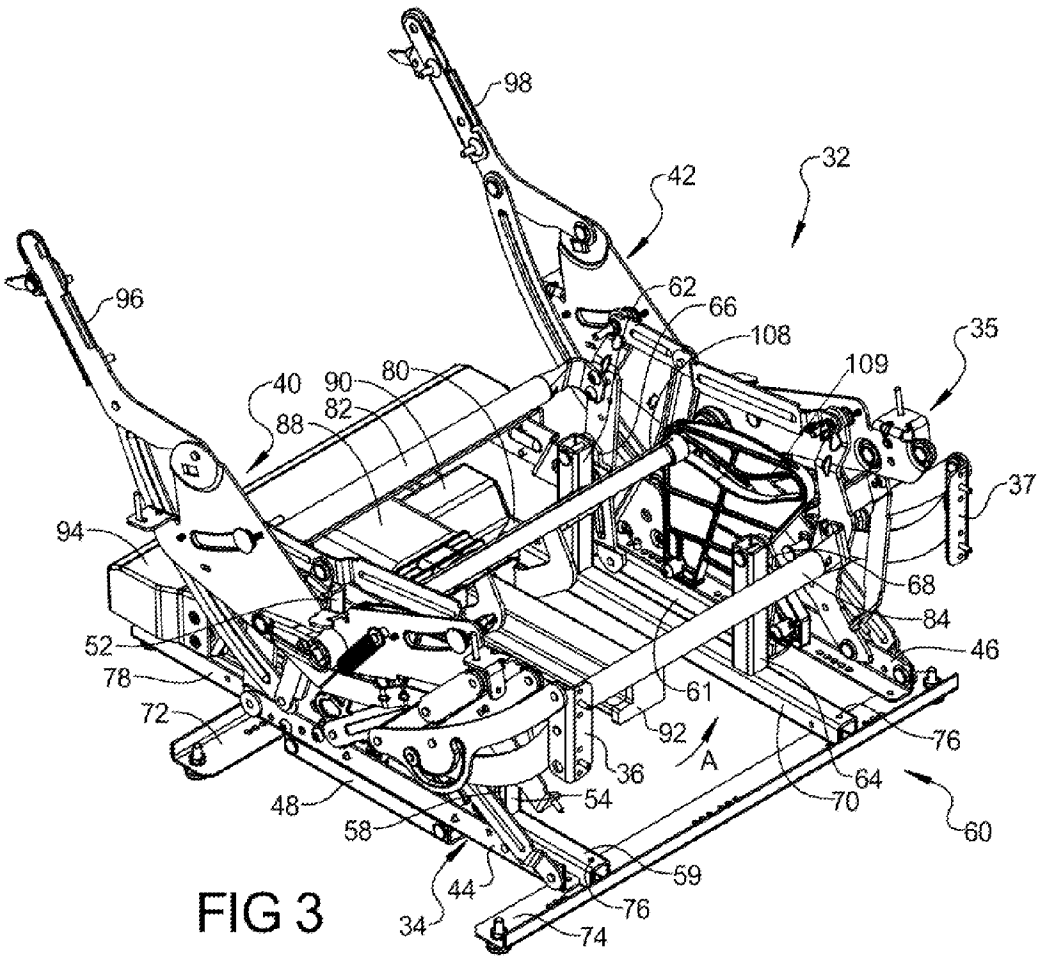
FIG. 3 is a right front perspective view of a glider mechanism of the present disclosure.

Referring to FIG. 3, the functional and structural aspects of actuation mechanism 32 for use in either single or multi-person furniture members 10 is shown. For purposes of clarity, FIG. 3 shows the various pre-assembled frame components with their upholstery, padding, etc. removed to better illustrate the interdependency of the mechanism components' construction which can be rapidly and efficiently assembled. Therefore, all of the mechanism components can be individually fabricated or sub-assembled to include the requisite brackets, springs, padding and upholstery on an "off-line" batch-type basis. Thereafter, the various pre-assembled and upholstered furniture components are assembled for totally integrating actuation mechanism 32 therein.

As generally used herein, the terms front or forward and right hand or left hand are oriented with respect to the direction an occupant of the furniture member 10 faces when seated or with respect to the occupant's sides when the occupant is seated. The terms rear or rearward refer to a direction opposite to the front or forward direction. A linkage portion of actuation mechanism 32 includes right and left side assemblies 40, 42, which are fixedly connected to and supported by right and left side support members 44, 46. Right and left side support members 44, 46 are individually connected to a first or second support structure 48, 50. First support structure 48 is rotatably linked to first and second posts 52, 54 by first and second glide links 56, 58 (only second glide link 58 is partially visible in this view). First and second posts 52, 54 are each fixed to a first longitudinal frame member 59 of a frame assembly 60 which supports all the components of actuation mechanism 32. Similar to first support structure 48, a second support structure 61 is rotatably linked to third and fourth posts 62, 64 by third and fourth glide links 66, 68. Third and fourth posts 62, 64 are each fixed to a second longitudinal frame member 70 of frame assembly 60. Each of the first, second, third and fourth posts 52, 54, 62, 64 can stand upright (substantially vertical) in a neutral position of actuation mechanism 32 and according to several embodiments are oriented substantially transverse to a longitudinal axis of the first and second longitudinal frame members 59, 70.

In addition, according to several embodiments the first and second longitudinal frame members 59, 70 can also be oriented at an angle with respect to the first and second longitudinal frame members 59, 70, or with respect to the ground or floor surface, or the ground or floor surface itself can be non-planar, each of the first, second, third and fourth posts 52, 54, 62, 64 can therefore also be oriented at an angle with respect to the floor or ground surface. However, in all positions of the actuation mechanism 32, upper ends of the first, second, third and fourth posts 52, 54, 62, 64 are elevated above the lower ends connected to the first and second longitudinal frame members 59, 70 such that the actuation mechanism is suspended from the upper ends of the first, second, third and fourth posts 52, 54, 62, 64.

Frame assembly 60 can also include rear and front cross members 72, 74 provided to space and provide structural rigidity to right and left side assemblies 40, 42, right and left side support members 44, 46, and first and second support structures 48, 50. Occupant loads at a front portion of furniture member 10 are transferred from second and fourth posts 54, 64 to front cross frame member 74 which is connected such as by fasteners 76 (which can be bolts, threaded fasteners, extension rivets, or the like). Similarly, occupant loads at a rear portion of furniture member 10 are transferred from first and third posts 52, 62 to rear cross frame member 72 which is connected such as by fasteners 76 (not clearly visible in this view) to rear cross frame member 72. Right and left frame extensions 78, 80 are connected to rear cross frame member 72 by fasteners 76 (not visible in this view). In some embodiments the frame members of frame assembly 60 can be created from formed, bent and/or extruded angle elements, of metal such as steel or aluminum, or of polymeric or composite materials. The present disclosure is not limited by the material used for the frame components.

Figure 4:
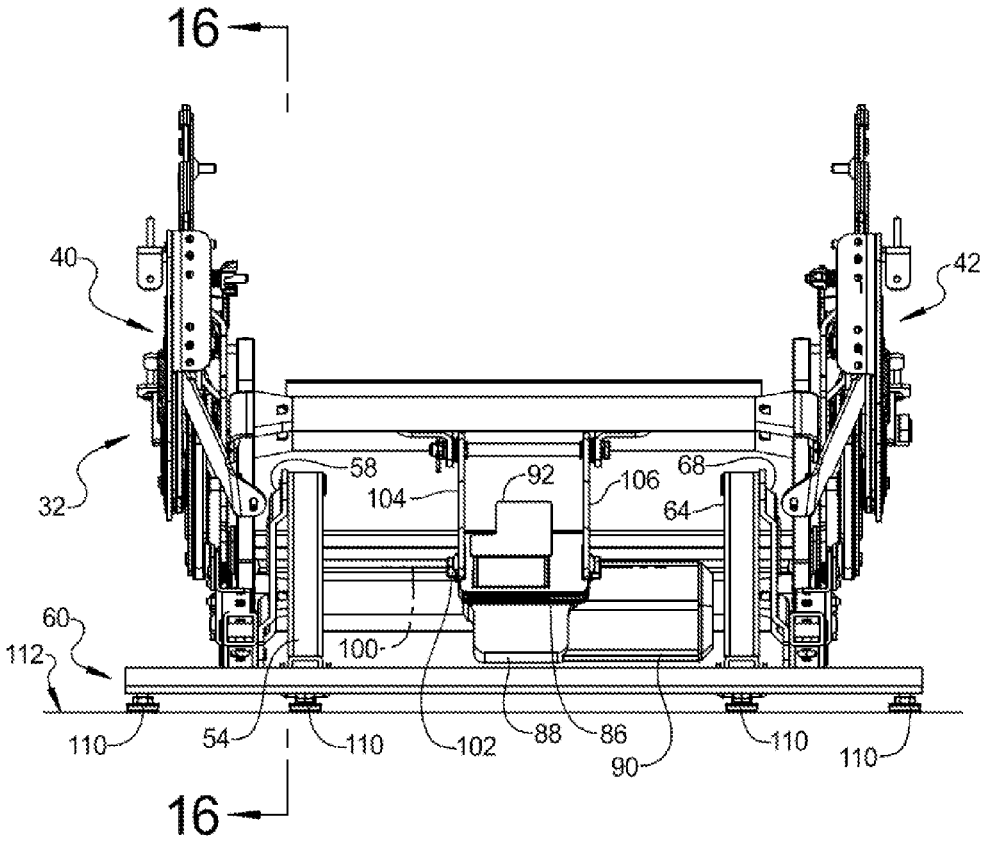
FIG. 4 is a front elevational view of the glider mechanism of FIG. 3.

A rear cross brace 82 and a front cross brace 84 connect right and left side assemblies 40, 42. A hinge pin assembly 86 (shown and described in greater detail in reference to FIG. 4) connected to rear cross brace 82 rotatably supports an electrically powered and occupant controlled drive assembly 88. A motor 90 such as an AC or DC electric motor is connected to drive assembly 88 to provide powered operation of actuation mechanism 32 via drive assembly 88. A gear housing 92 can extend forward from drive assembly 88 and provide for a gear drive such as a worm drive gear. Drive assembly 88 and gear housing 92 are together freely rotatable with respect to hinge pin assembly 86. A cover member 94 is connected to right and left side support members 44, 46 which at least partially covers hinge pin assembly 86, drive assembly 88 and motor 90. Right and left seat back support members 96, 98 are rotatably connected to individual ones of the right and left side assemblies 40, 42.

Referring to FIG. 4 and again to FIG. 3, drive assembly 88 is rotatable about a longitudinal axis of rotation 100 defined by a hinge pin 102 rotatably received in hinge pin assembly 86. Drive assembly 88 including motor 90 and gear housing 92 rotate about longitudinal axis of rotation 100 from the position shown in FIG. 3 in an upward arc of rotation "A" as the leg rest assembly 24 (only partially shown in FIG. 3 as first and second pantograph linkage sets 34, 35 and first and second leg rest support arms 36, 37) is rotated from the stowed position towards an extended position. The drive assembly 88 is connected in part using first and second rigid drive links 104, 106 to a drive rod 108 (more clearly visible in FIG. 3). Each of the first and second rigid drive links 104, 106 are fixedly connected to drive assembly 88. Actuation mechanism 32 is connected to frame assembly 60 which includes a plurality of adjustable height leg members 110 to establish an even distribution of weight load of actuation mechanism 32, furniture member 10 and the occupant to a substantially planar surface 112 such as a floor.

Figure 5:
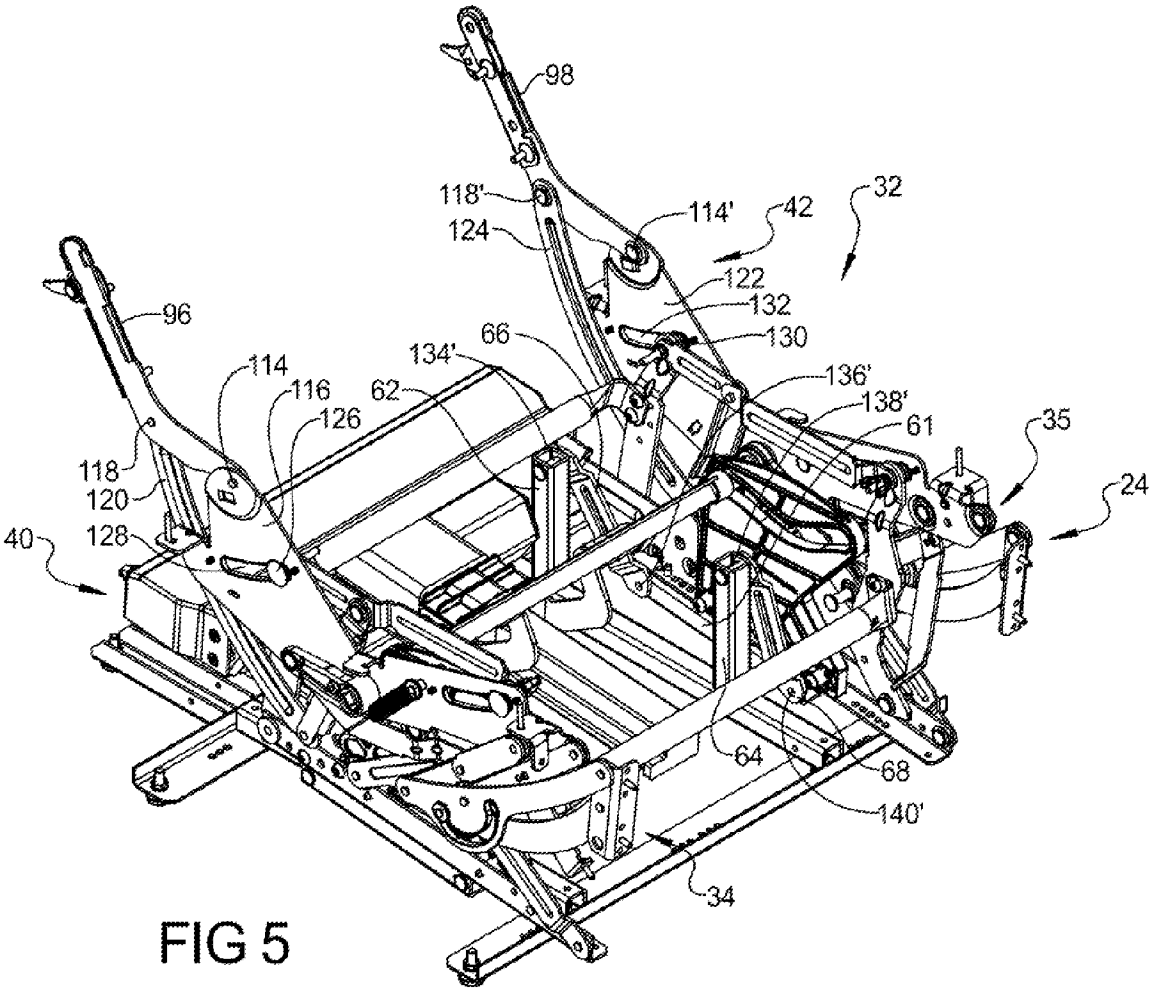
FIG. 5 is a right front perspective view of the glider mechanism of FIG. 3 in a forward glide position.

Referring to FIG. 5, with the first and second pantograph linkage sets 34, 35 of leg rest assembly 24 in the fully retracted position, and both right and left seat back support members 96, 98 in the seat back upright positions, actuation mechanism 32 can be moved using the force of an occupant of the furniture member (for example by a forward rocking motion or by using the occupant's feet to pull the mechanism forward) to a forward glide position shown. Right seat back support member 96 is rotatably connected using a rotational fastener 114 to a first plate member 116 of right side assembly 40. Right seat back support member 96 is also rotatably connected using a rotational fastener 118 to a first arc shaped link 120. Similarly, left seat back support member 98 is rotatably connected to a second plate member 122 of left side assembly 42 using a rotational fastener 114'. Left seat back support member 98 is further rotatably connected to a second arc shaped link 124 using a rotational fastener 118'.

The seat back fully upright position is also maintained by contact between a first pin 126 and a forward end of an elongated slot 128 created in first plate member 116. Similarly, a second pin 130 is in contact with a forward end of an elongated slot 132 created in second plate member 122 in the seat back fully upright position.

Because the elements of right side assembly 40 are not clearly visible in this view, the following discussion with respect to the elements of left side assembly 42 apply equally to the elements in a mirror image configuration arranged in the right side assembly 40. As the force applied by the occupant of the furniture member is applied in the forward direction with respect to actuation mechanism 32, third and fourth glide links 66, 68 rotate counter-clockwise as viewed in FIG. 5 with respect to third and fourth posts 62, 64. Third glide link 66 is rotatably connected to third post 62 at an upper end of third post 62 using a rotational fastener 134' such as a spin rivet. An opposed or lower end of third glide link 66 is rotatably connected to second support structure 61 using a rotational fastener 136'. Similarly, an upper end of fourth glide link 68 is rotatably connected to an upper end of fourth post 64 using a rotational fastener 138'. A lower end of fourth glide link 68 is rotatably connected to second support structure 61 using a rotational fastener 140'. There is no positive stop for forward glide motion of actuation mechanism 32, so the total displacement in the forward direction can vary between individual swings.

Figure 6:
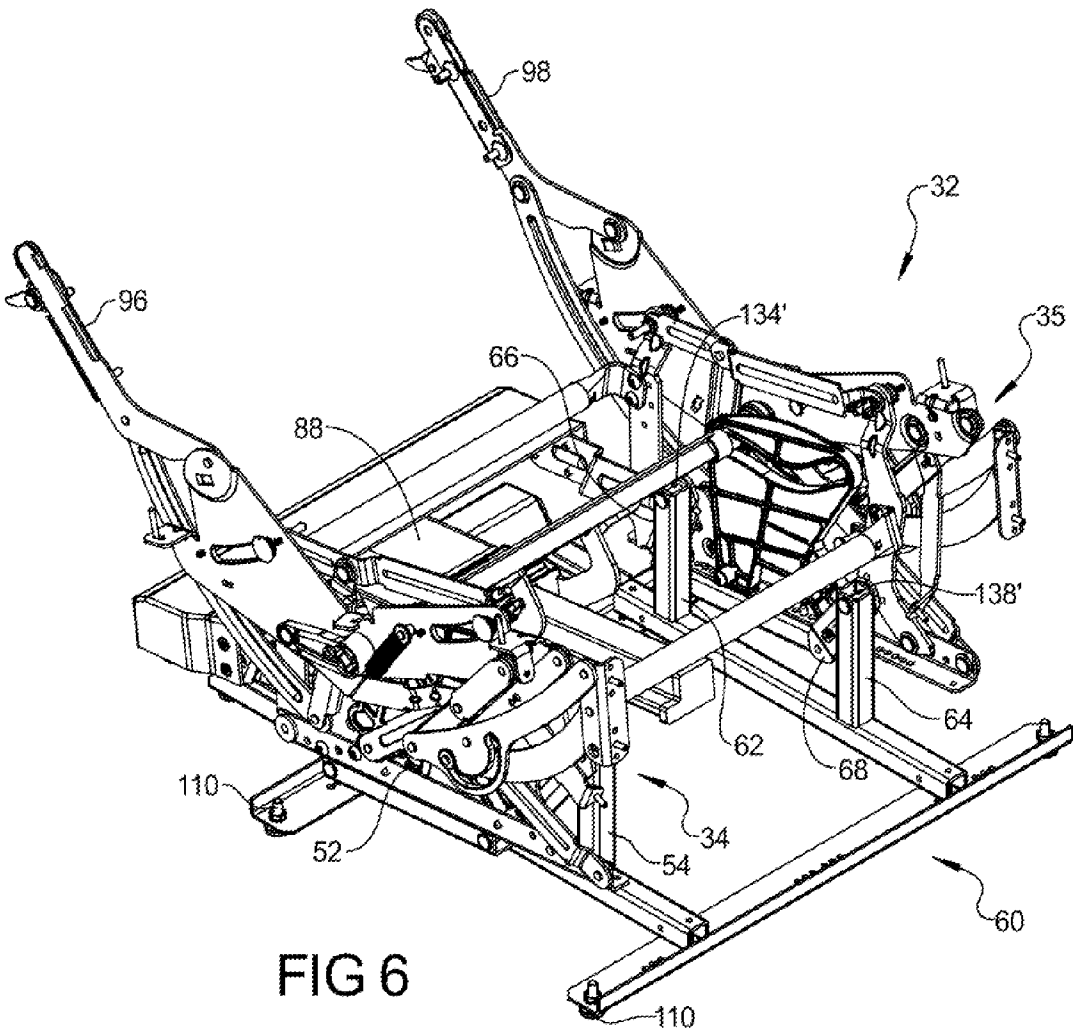
FIG. 6 is a right front perspective view of the glider mechanism of FIG. 3 in a rearward glide position.

Referring to FIG. 6, actuation mechanism 32 is shown in a rear glide position with first and second pantograph linkage sets 34, 35 in the fully retracted position and right and left seat back support members 96, 98 in the fully upright positions. It is noted that no powered operation of drive assembly 88 is required to reach either the rear glide position shown in FIG. 6 or the forward glide position shown in FIG. 5. Therefore, gliding motion is provided by manual force input from the occupant of the furniture member only. In the rear glider position, the lower end of third glide link 66 is positioned rearwardly of third post 62. Similarly, the lower end of fourth glide link 68 is also positioned rearwardly of fourth post 64. Frame assembly 60 is configured to support actuation mechanism 32 between the full extent of the rear glide position and the forward glide position such that each of the adjustable height leg members 110 remain in contact with the planar surface 112 shown and described with reference to FIG. 4.

Figure 7:
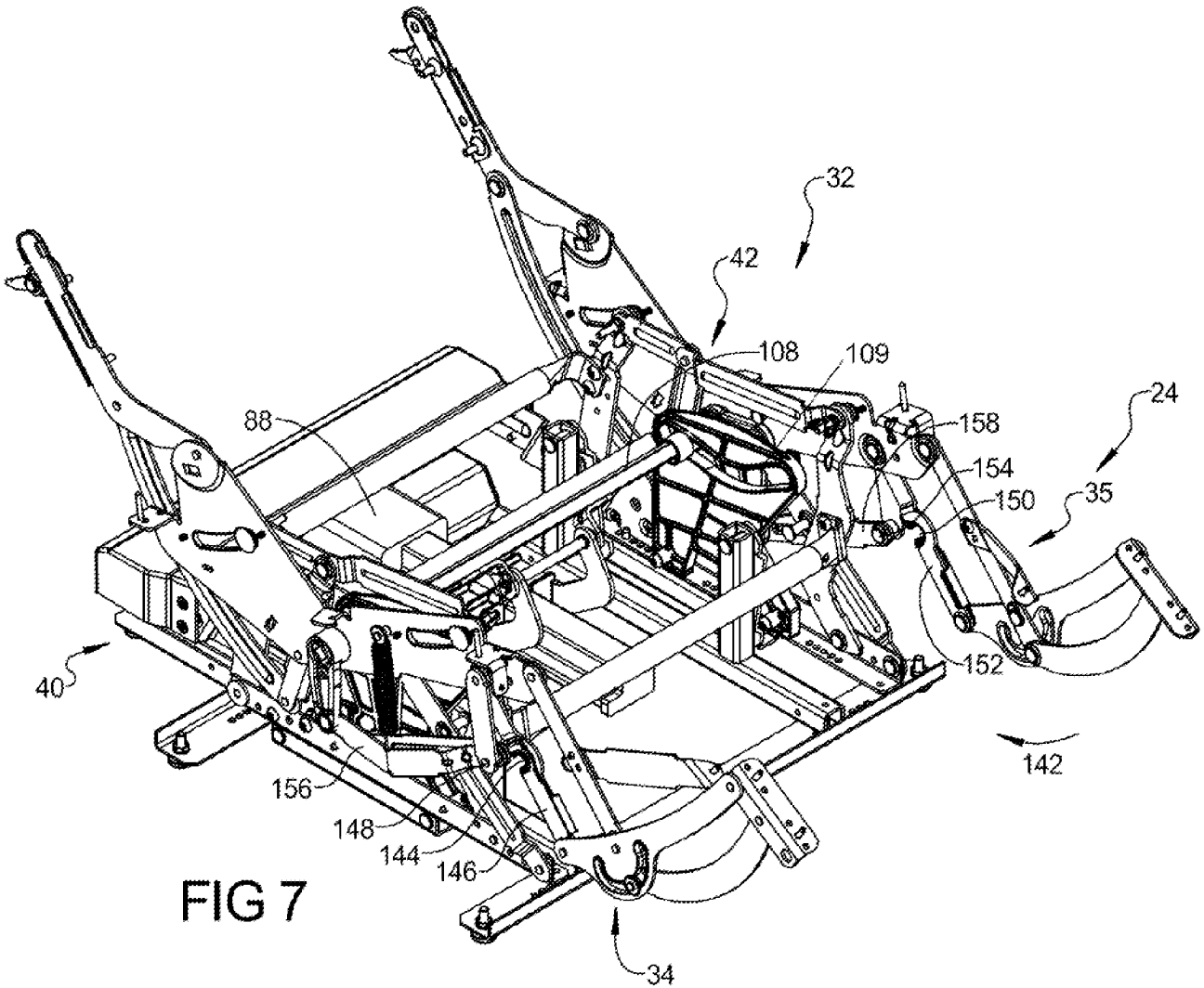
FIG. 7 is a right front perspective view of the glider mechanism having the leg rest assembly in a partially extended position.
Figure 19:
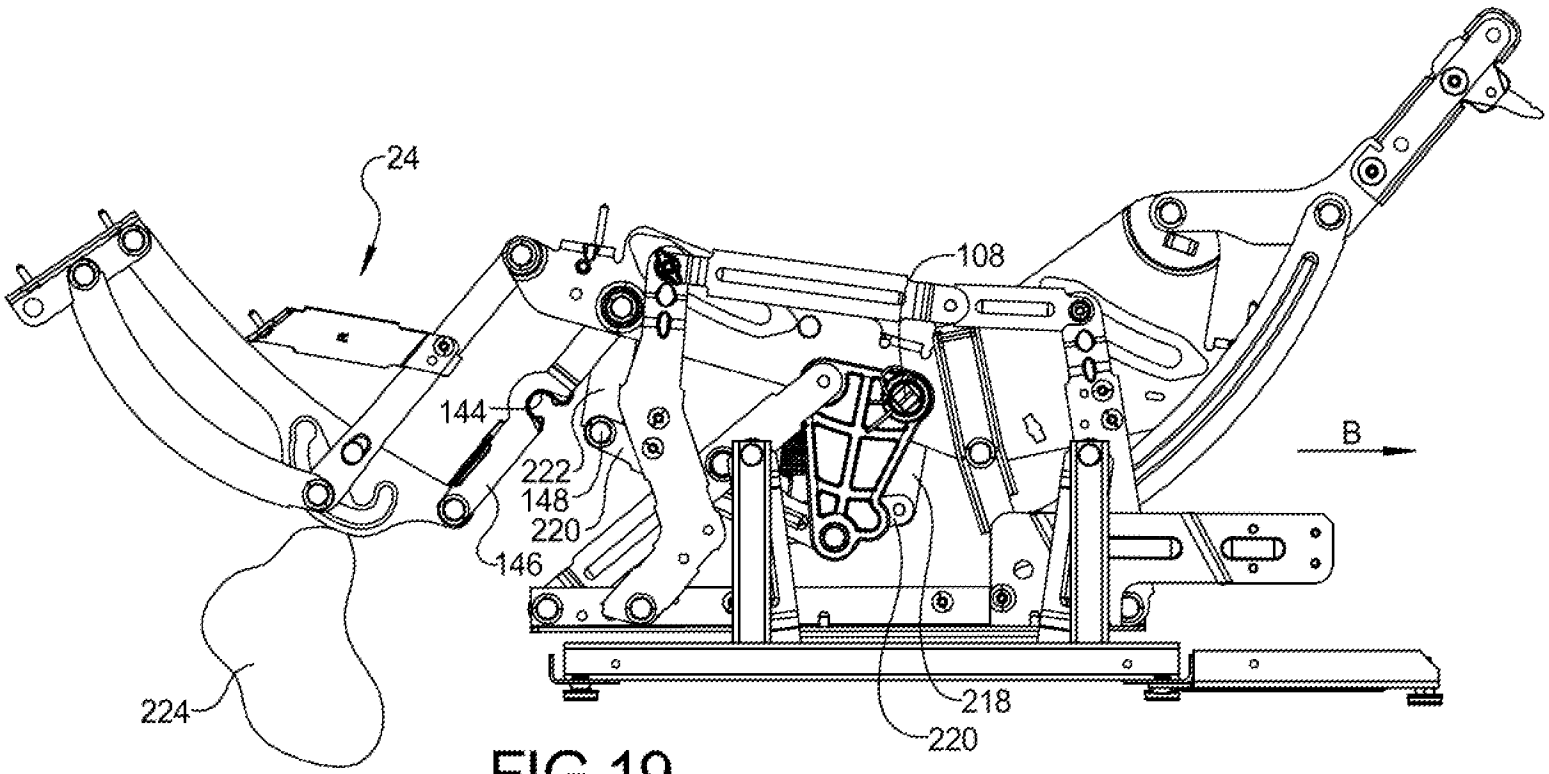
FIG. 19 is the cross sectional elevational view of the mechanism portion of FIG. 16 further showing the leg rest in a partially extended release position.

Referring to FIGS. 7 and 19, actuation mechanism 32 provides for a powered retraction of leg rest assembly 24 from the fully extended to the fully retracted positions. Therefore, if the first or second pantograph linkage sets 34, 35 contact an object 224 during rotation about a leg rest retraction arc of rotation 142, either or both of the first and second pantograph linkage sets 34, 35 include a release feature to stop further retraction motion of first and second pantograph linkage sets 34, 35 by drive assembly 88. To provide for this disconnection feature, a first semi-circular cavity 144 created in a first link member 146 of first pantograph linkage set 34 can release with respect to a first engagement pin 148. Similarly, a second semi-circular cavity 150 created in a second link member 152 of second pantograph linkage set 35 can disconnect from a second engagement pin 154. First and second pantograph linkage sets 34, 35, after release from first and second engagement pins 148, 154, will remain in contact with the object 224 until removal of the object 224, at which point the first and second pantograph linkage sets 34, 35 will return by gravity in the leg rest retraction arc of rotation 142. First engagement pin 148 is connected to a first drive link 156 and second engagement pin 154 is connected to a second drive link 158 of left side assembly 42. It is also noted that release from either or both of the first or second engagement pins 148, 154 can also occur if an object is encountered under either of the first or second pantograph linkage sets 34, 35 during gliding motion of the furniture member. Once the object is removed from contact with either or both of the first and second pantograph linkage sets 34, 35, the occupant can push either or both of the first and second pantograph linkage sets 34, 35 toward the fully retracted position of leg rest assembly 24 until re-engagement of the first and second engagement pins 148, 154 occurs.

Figure 8:
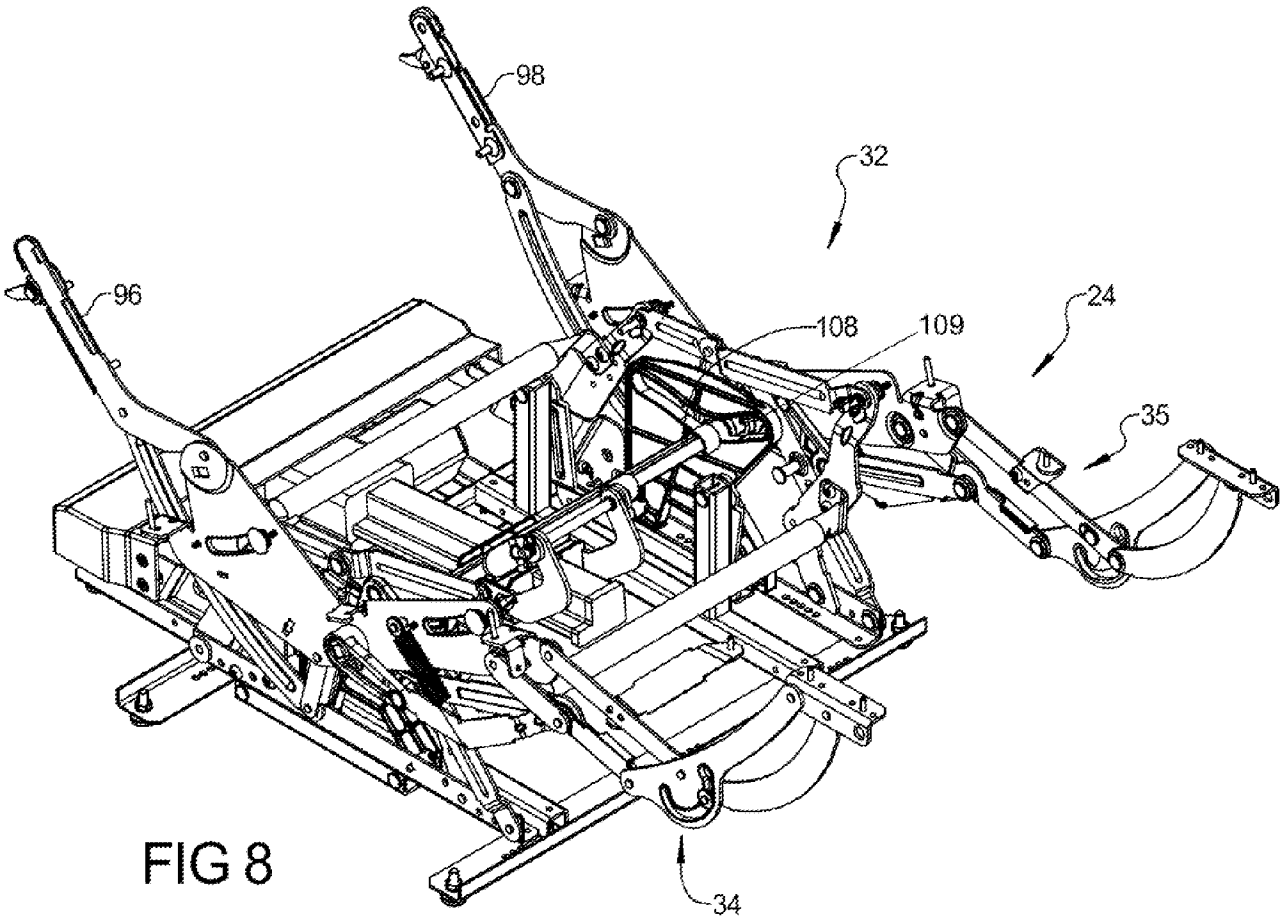
FIG. 8 is a right front perspective view of the glider mechanism in a leg rest fully extended position.

Referring to FIG. 8, first and second pantograph linkage sets 34, 35 are shown in the fully extended position of leg rest assembly 24, while right and left seat back support members 96, 98 are retained in the seat back fully upright positions. Forward and rearward gliding motion of actuation mechanism 32 is unaffected by having the leg rest assembly 24 in the fully extended position. Because the weight of the occupant supported by leg rest assembly 24 is extended further away from the drive rod 108, gliding motion in the forward direction may be somewhat reduced, while gliding motion in the rearward direction can increase.

Figure 9:
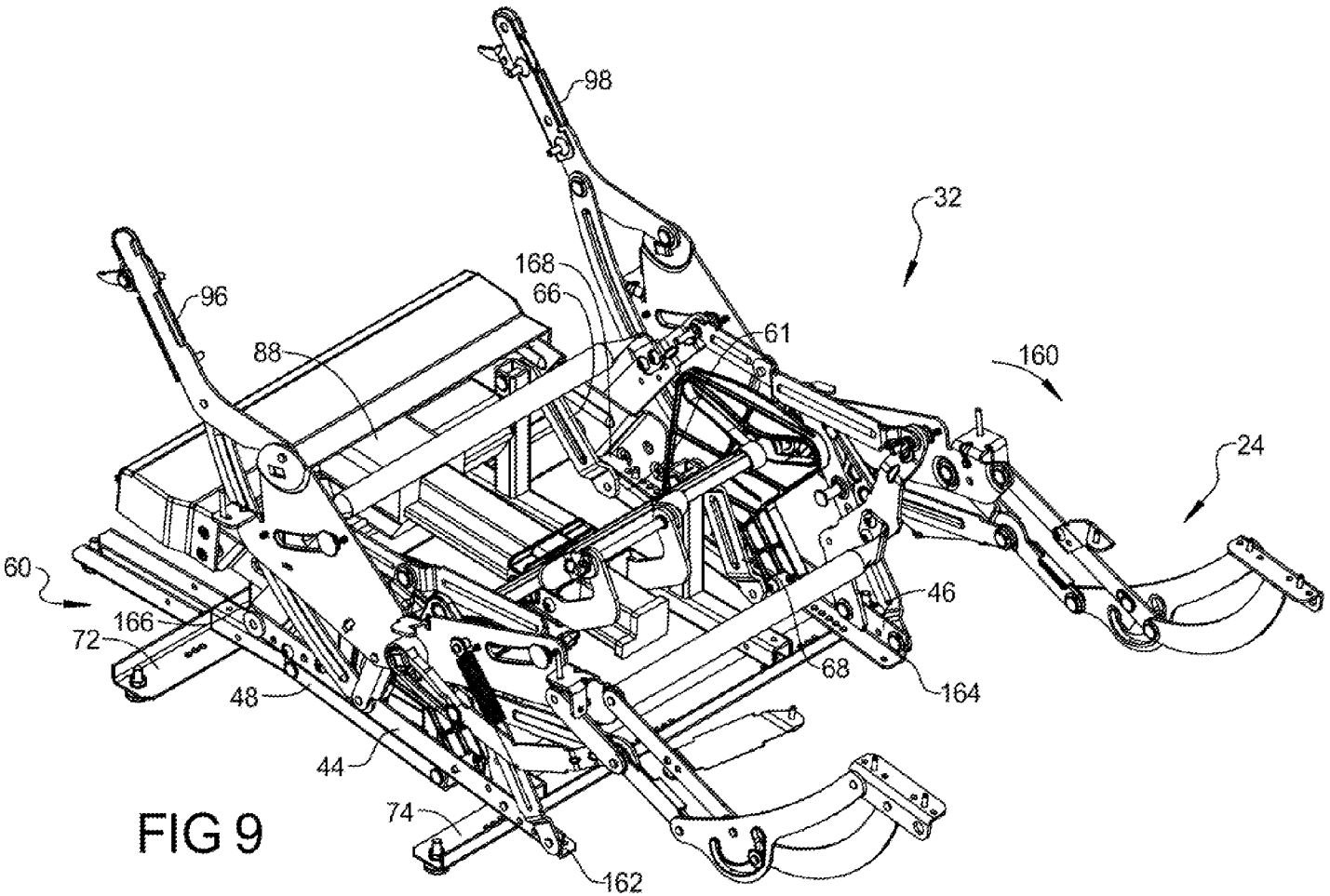
FIG. 9 is a right front perspective view of the glider mechanism with the leg rest assembly in the fully extended position and further shown in the fully forward glide position.

Referring to FIG. 9, the forward glide position of actuation mechanism 32 is shown with the leg rest assembly 24 in the fully extended position and right and left seat back support members 96, 98 positioned in the seat back fully upright position. In the forward glide position, the leg rest assembly 24 moves generally in a forward glide arc 160, which is substantially forward and downward from the neutral position shown with respect to FIG. 8. A forward facing end 162 of right side support member 44 and a forward facing end 164 of left side support member 46 are both positioned below a rear facing end 166 of right side support member 44 and a rear facing end 168 of left side support member 46. As also evident in FIG. 9, the forward facing ends 162, 164 of right and left side support members 44, 46 extend generally forward of front cross member 74 in the forward glide position.

Figure 10:
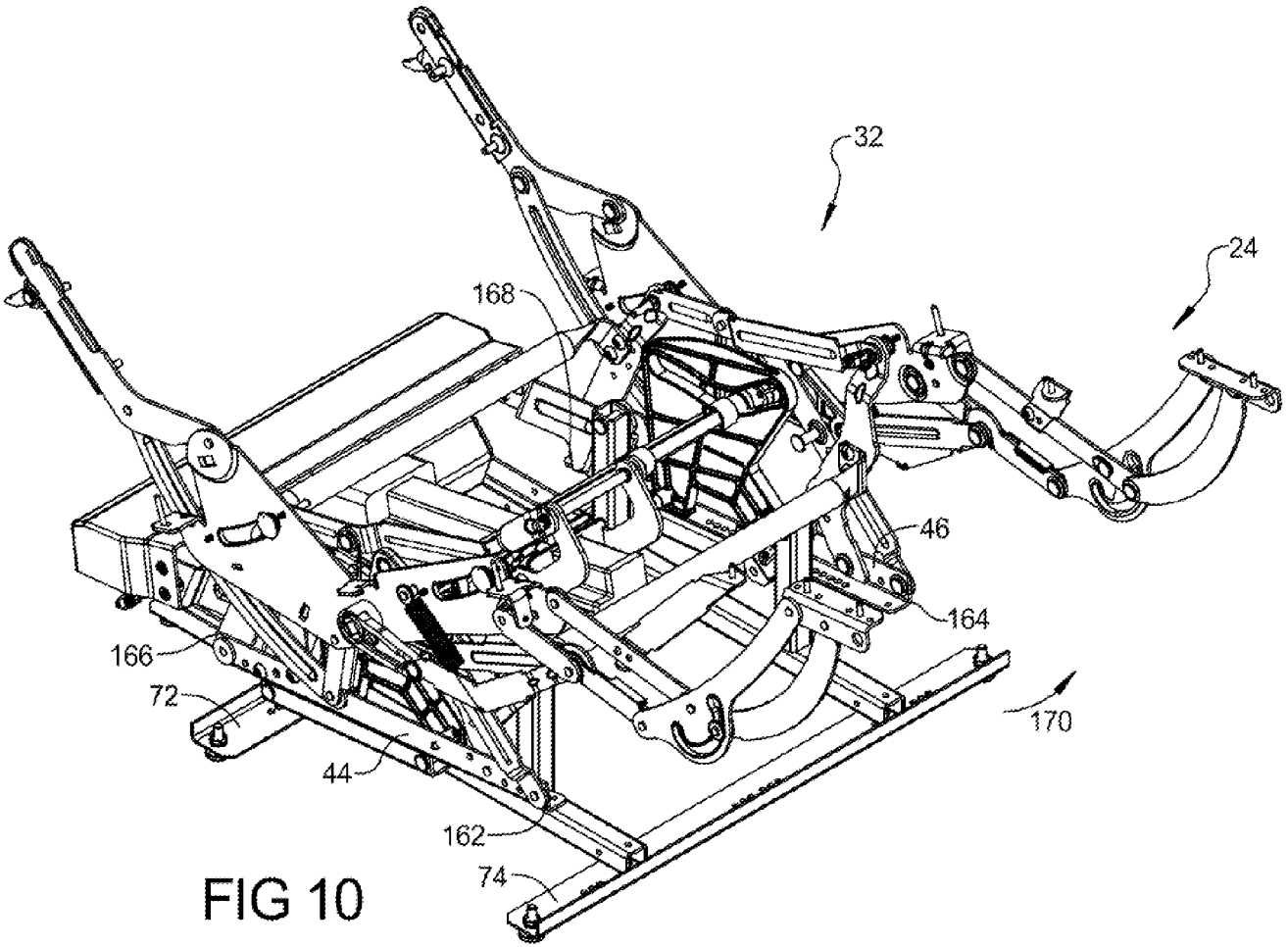
FIG. 10 is a right front perspective view of the glider mechanism with the leg rest assembly in the fully extended position and further shown in the fully rearward glide position.

Referring to FIG. 10, in the rear glider position, the leg rest assembly 24 moves in a rear glide arc of rotation 170 until forward facing ends 162, 164 of right and left side support members 44, 46 are positioned above each of the rear facing ends 166, 168 of right and left side support members 44, 46. Also in the rear glider position, rear facing ends 166, 168 of right and left side support members 44, 46 extend rearwardly of rear cross member 72.

Figure 11:
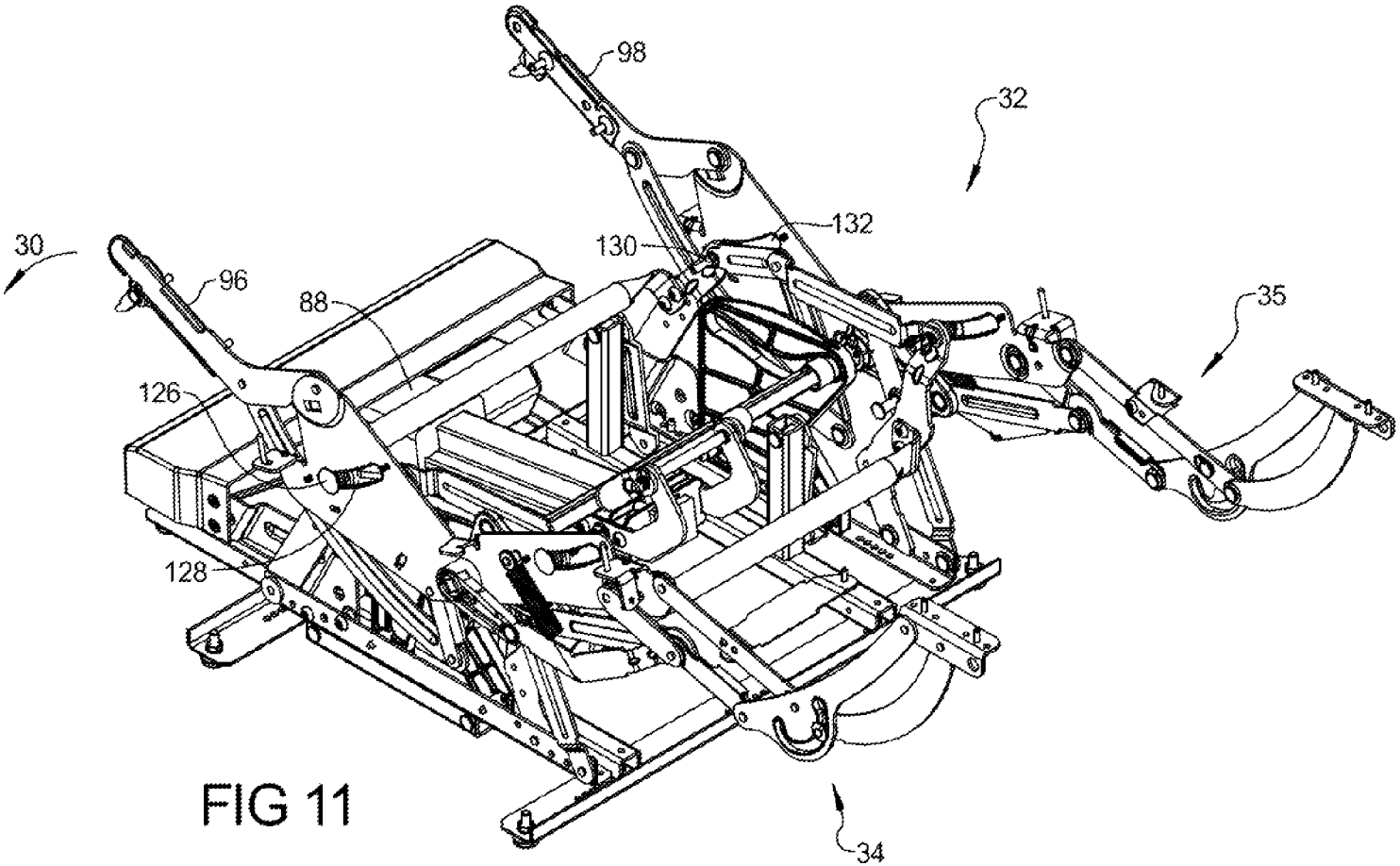
FIG. 11 is a right front perspective view of the glider mechanism with the leg rest assembly in the fully extended position and the seat back member in a fully reclined position.

Referring to FIG. 11, after first and second pantograph linkage sets 34, 35 reach the leg rest fully extended position, continued operation of drive assembly 88 thereafter rotates right and left seat back support members 96, 98 from the upright to the fully reclined position shown in FIG. 11. Right and left seat back support members 96, 98 rotate about the seat back recline arc of rotation 30 to reach the seat back fully reclined position. The seat back fully reclined position is established when first pin 126 contacts the rear facing end of elongated slot 128 and second pin 130 contacts the rear facing end of elongated slot 132, thereafter preventing further rotation about the seat back recline arc of rotation 30. It is noted that actuation mechanism 32 is capable of glide motion with both the right and left seat back support members 96, 98 in the seat back fully reclined position and the first and second pantograph linkage sets 34, 35 in the leg rest fully extended position. Glider motion of actuation mechanism 32 is, therefore, independent of drive assembly 88 in the positions shown in FIG. 11.

Figure 12:
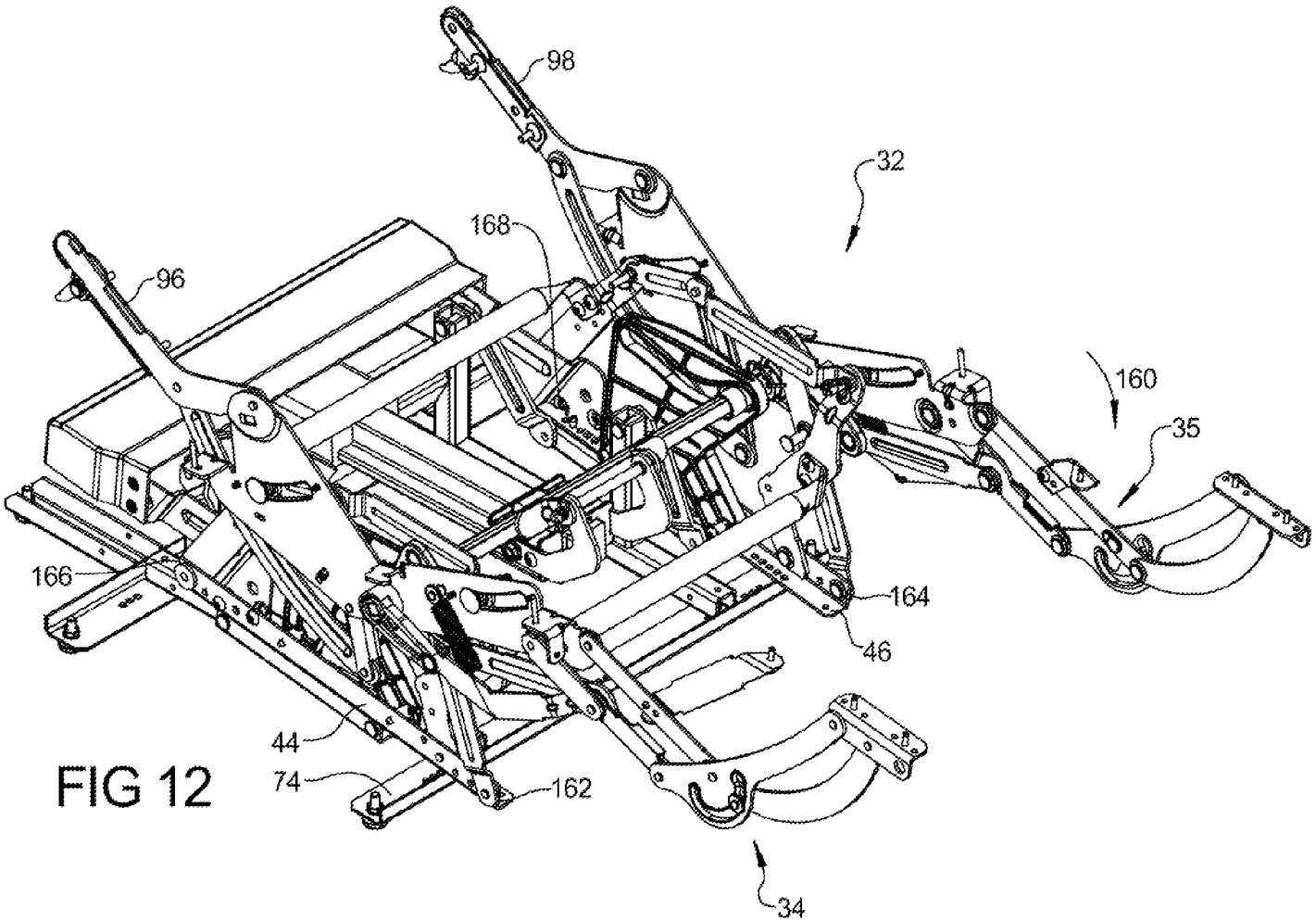
FIG. 12 is a right front perspective view of the glider mechanism with the leg rest assembly in the fully extended position and the seat back member in a fully reclined position and further shown in the fully forward glide position.

Referring to FIG. 12, the forward glider position of actuation mechanism 32 is shown with the first and second pantograph linkage sets 34, 35 in the leg rest fully extended position and right and left seat back support members 96, 98 in the fully reclined position. Similar to the positions shown and previously described with reference to FIG. 9, forward facing ends 162, 164 of right and left side support members 44, 46 are below the elevated position of rear facing ends 166, 168 of right and left side support members 44, 46. Also, forward facing ends 162, 164 are positioned generally forward of front cross member 74 in this forward glider position. Because the weight of the occupant can be distributed in a further rearward direction when the right and left seat back support members 96, 98 are positioned in the fully reclined position, total rearward motion of actuation 32 may be reduced with respect to the configuration shown and described in reference to FIG. 9.

Figure 13:
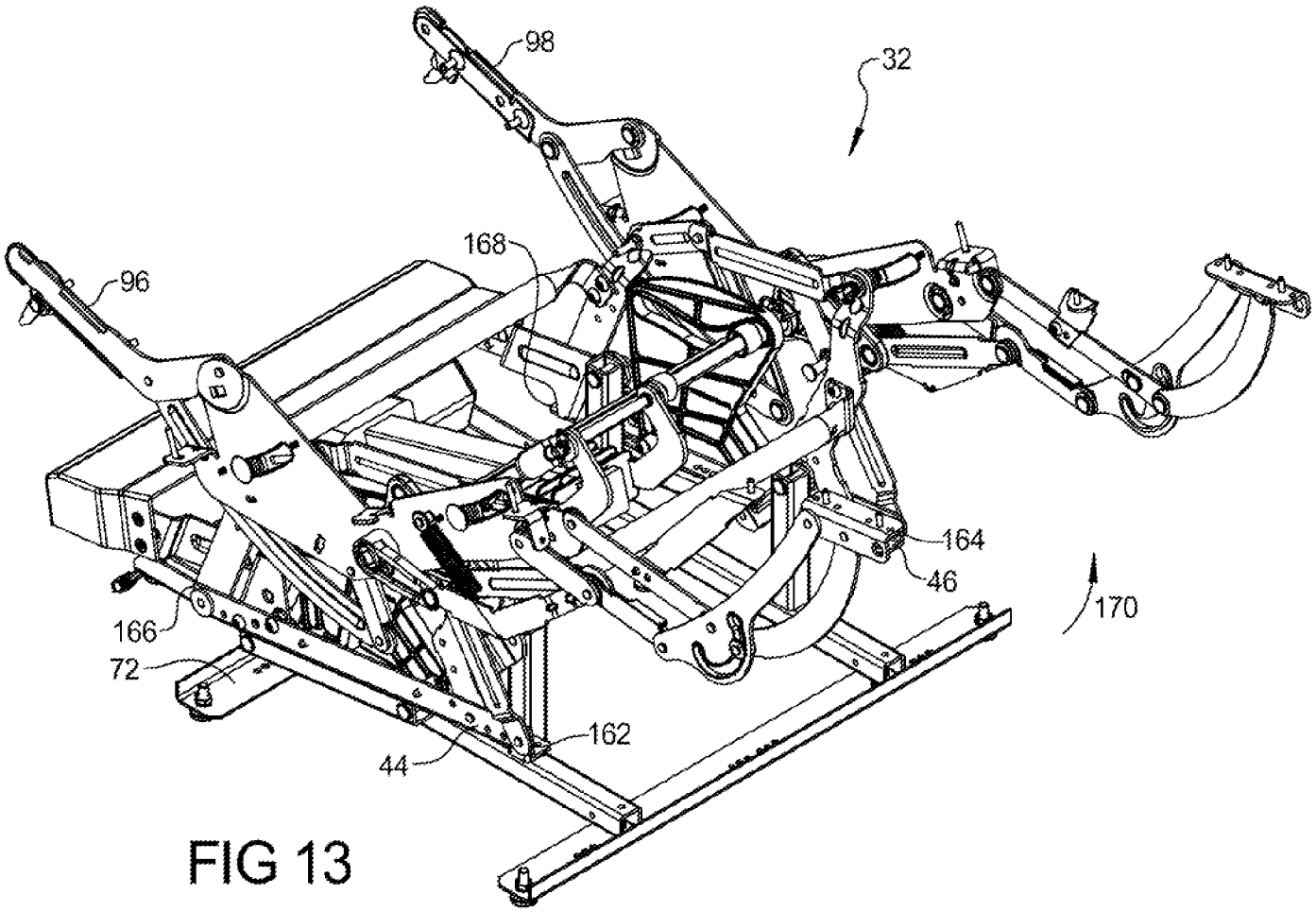
FIG. 13 is a right front perspective view of the glider mechanism with the leg rest assembly in the fully extended position and the seat back member in a fully reclined position and further shown in the fully rearward glide position.

Referring to FIG. 13, when right and left seat back support members 96, 98 are in the fully reclined position the rear glider position of actuation mechanism 32 results in forward facing ends 162, 164 of right and left side support members 44, 46 being positioned in an elevated position with respect to rear facing ends 166, 168 of right and left side support members 44, 46. Similar to the orientation shown and described with reference to FIG. 10, rear facing ends 166, 168 are positioned rearwardly with respect to rear cross member 72 in the rear glider position.

Figure 14:
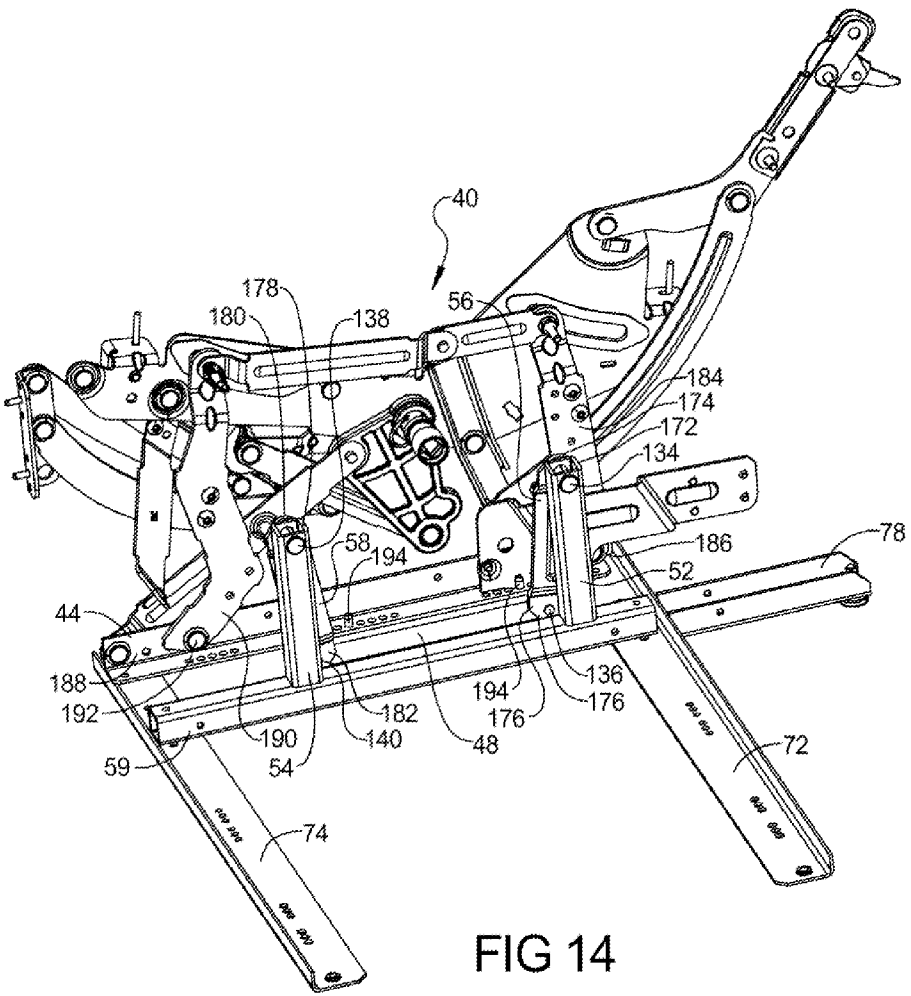
FIG. 14 is a front left perspective view of the right side assembly of the mechanism of FIG. 3.

Referring to FIG. 14, features of right side assembly 40 are shown and described. Features of left side assembly 42 are mirror images of right side assembly 40 and are therefore not further discussed. Rotational fastener 134 is received proximate an upper post end 172 of first post 52. Rotational fastener 134 extends through an upper link end 174 of first glide link 56 to rotatably connect first glide link 56 to first post 52. Rotational fastener 136 is rotationally received through a lower link end 176 of first glide link 56 and a rear facing end of first support structure 48 to rotatably connect first glide link 56 to first support structure 48. Rotational fastener 138 is received proximate an upper post end 178 of second post 54. Rotational fastener 138 extends through an upper link end 180 of second glide link 58 to rotatably connect second glide link 58 to second post 54. Rotational fastener 140 is rotationally received through a lower link end 182 of second glide link 58 and a forward facing end of first support structure 48 to rotatably connect second glide link 58 to first support structure 48.

Right side assembly 40 is rotatably connected at a rear support link 184 rotatably connected using a rotational fastener 186 to a first flange 188 of right side support member 44. A forward support link 190 is also rotatably connected using a rotational fastener 192 to first flange 188 of right side support member 44. Right side support member 44 is fastened to first support structure 48 using fasteners 194. Approximately half the weight of the actuation mechanism, the upholstery components, and the occupant of the furniture member is therefore borne by first support structure 48 which is suspended from the first and second posts 52, 54 by the first and second glide links 56, 58. Forward and rearward gliding motions of the actuation mechanism are therefore allowed by rotation of the rotational fasteners 134, 138 connected to first and second posts 52, 54, and by rotation of rotational fasteners 136, 140 with respect to first support structure 48.

Figure 15:
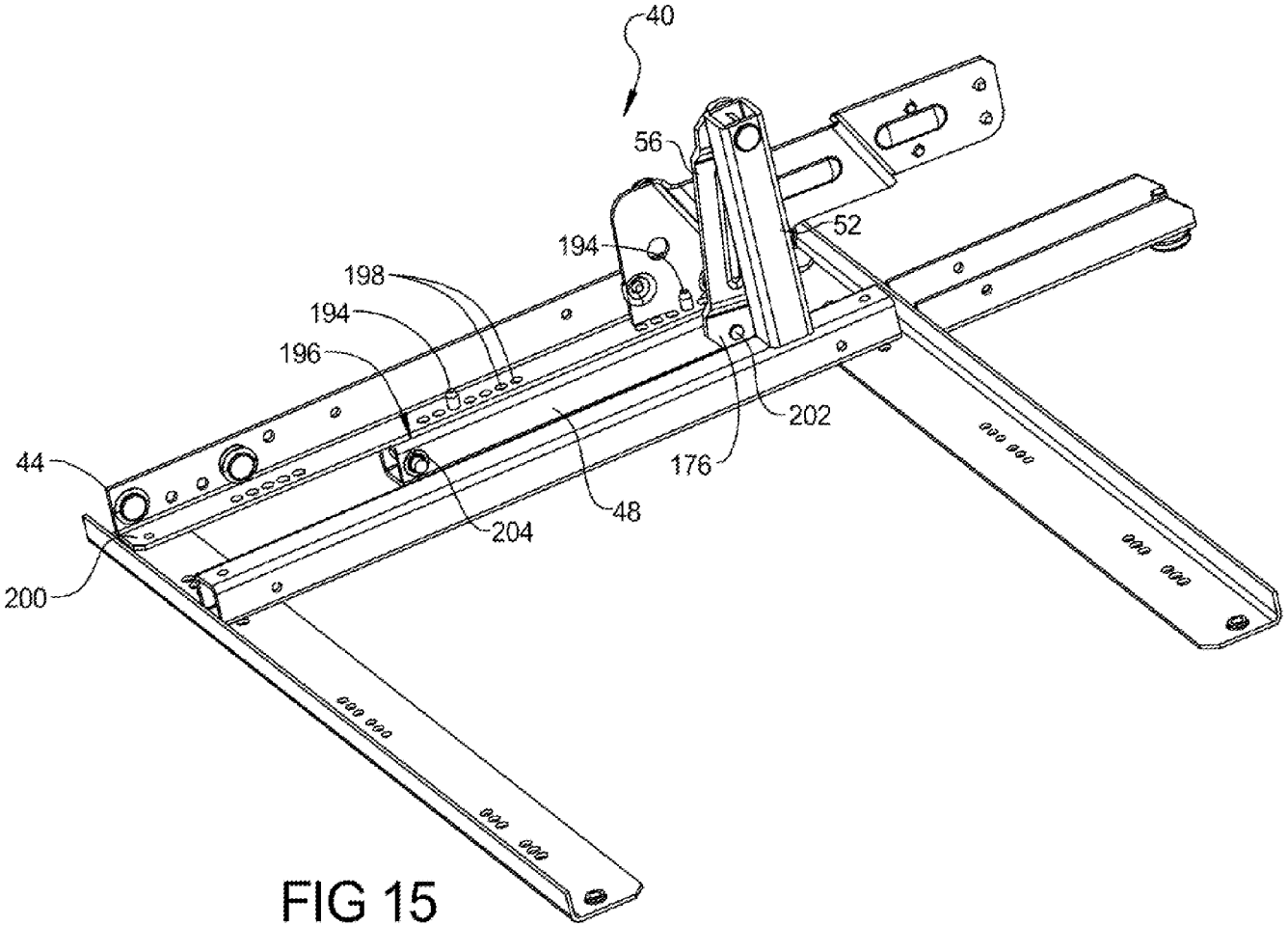
FIG. 15 is a front left perspective view modified from FIG. 14 to remove further components for clarity.

Referring to FIG. 15 and again to FIGS. 5 and 14, fasteners 194 extend upwardly from a planar face 196 of first support structure 48 and are received through selected ones of a plurality of apertures 198 created in a second flange 200 of right side support member 44. A fastener aperture 202 created in lower link end 176 of first glide link 56 (and similarly created in the lower link end 182 of second glide link 58) is axially aligned with bearing tubes 204 positioned at opposite ends of first support structure 48. Bearing tubes 204 are sized to permit rotational movement of rotational fasteners 136, 140 receiving within a bore of bearing tubes 204. Bearing tubes 204 can be fixed such as by flaring, peening, welding, or similar fixing operation through a substantially rectangular shaped body of first support structure 48.

Figure 16:
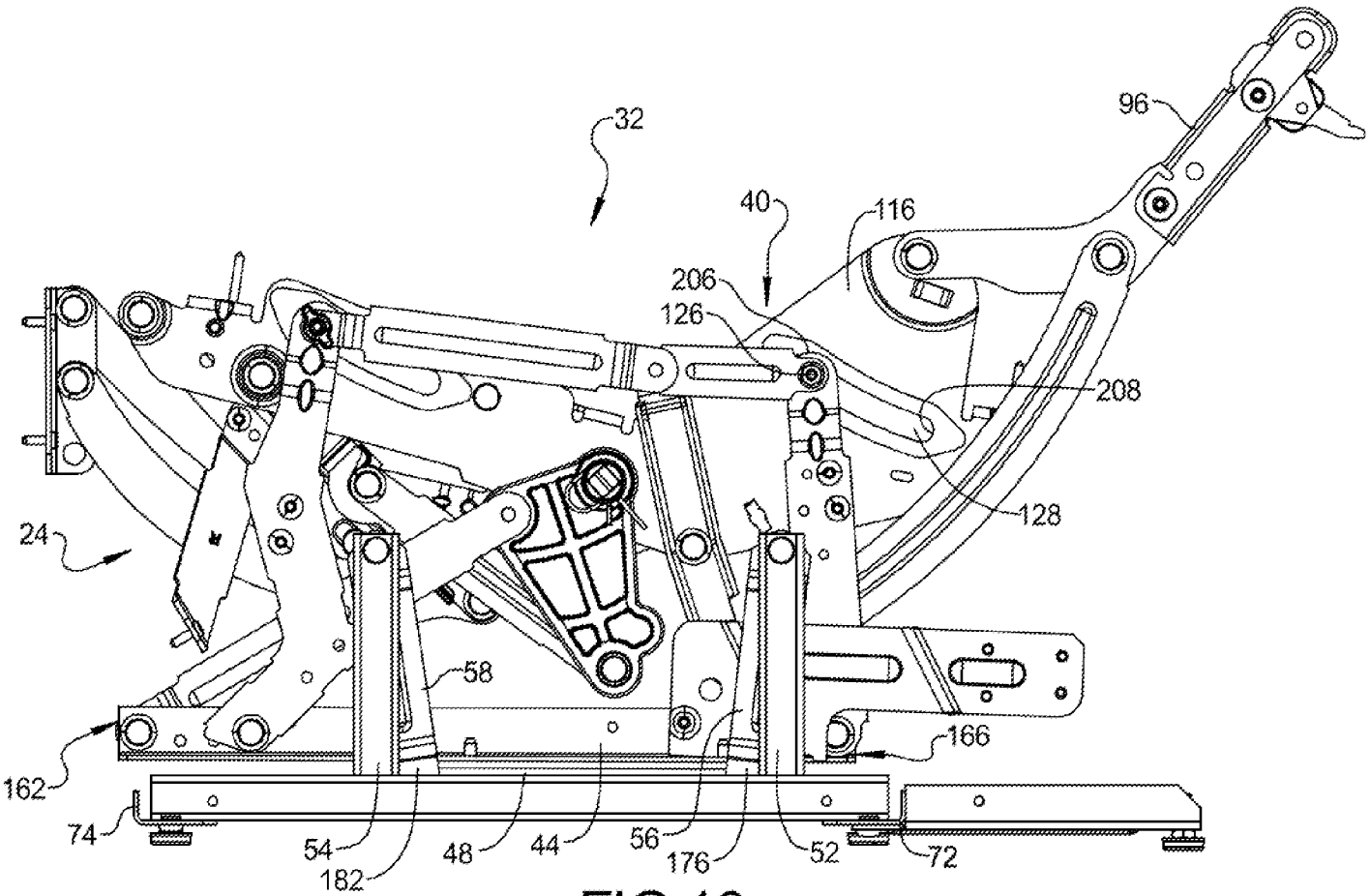
FIG. 16 is a cross sectional elevational view taken at section 16 of FIG. 4.

Referring to FIG. 16, a neutral or start position of actuation mechanism 32 is depicted. In the neutral position, the leg rest assembly 24 is in the fully retracted position and the seat back member represented by right seat back support member 96 is in the fully upright position. The seat back fully upright position is defined by contact between first pin 126 and a forward end 206 of elongated slot 128 created in first plate member 116. The seat back fully reclined position is reached (which is shown and described in better detail in reference to FIG. 21) when first pin 126 contacts an oppositely located rearward facing end 208 of elongated slot 128. To help retain a stable neutral position, the lower link ends 176, 182 of first and second glide links 56, 58 can be angled toward each other, in lieu of being oriented substantially co-axial with the first and second posts 52, 54.

Figure 17:
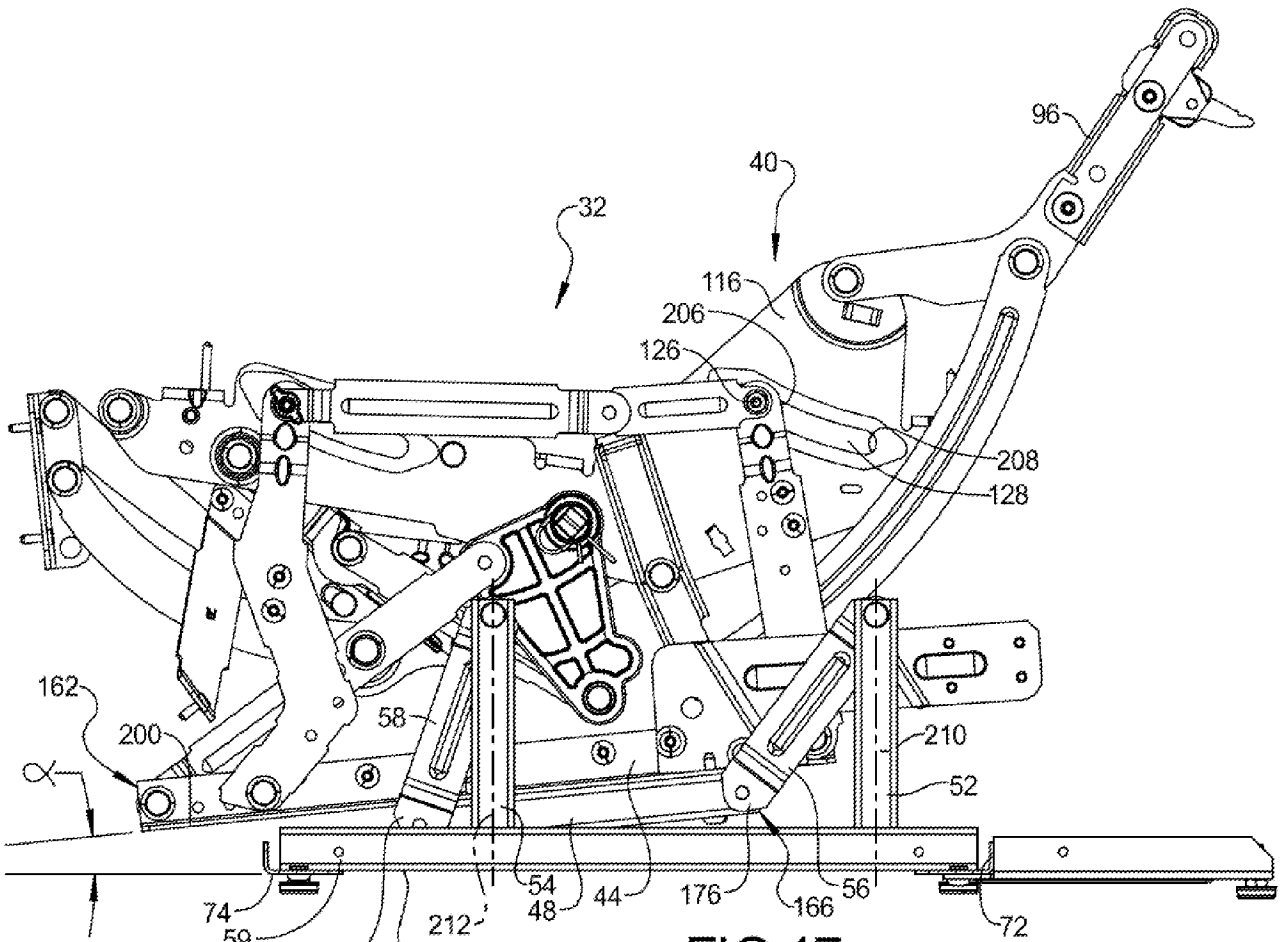
FIG. 17 is the cross sectional elevational view of the mechanism portion of FIG. 16 further shown in the forward glide position.

Referring to FIG. 17, with leg rest assembly 24 in the fully retracted position and the seat back member represented by right seat back support member 96 in the fully upright position, when actuation mechanism 32 is moved to the forward glide position the rotational fasteners 136, 140 connected to lower link ends 176 and 182 of first and second glide links 56, 58 are individually positioned substantially forward of first and second longitudinal axes 210, 212 of the respective first and second posts 52, 54. Forward facing end 162 of right side support member 44 is positioned forward of front cross member 74, and rear facing end of 166 of right side support member 44 is positioned forward of second longitudinal axis 212. In the forward glide position second flange 200 of right side support member 44 defines an angle alpha ($\alpha$) with respect to the plane defined by a lower surface 216 of first longitudinal frame member 59.

Figure 18:
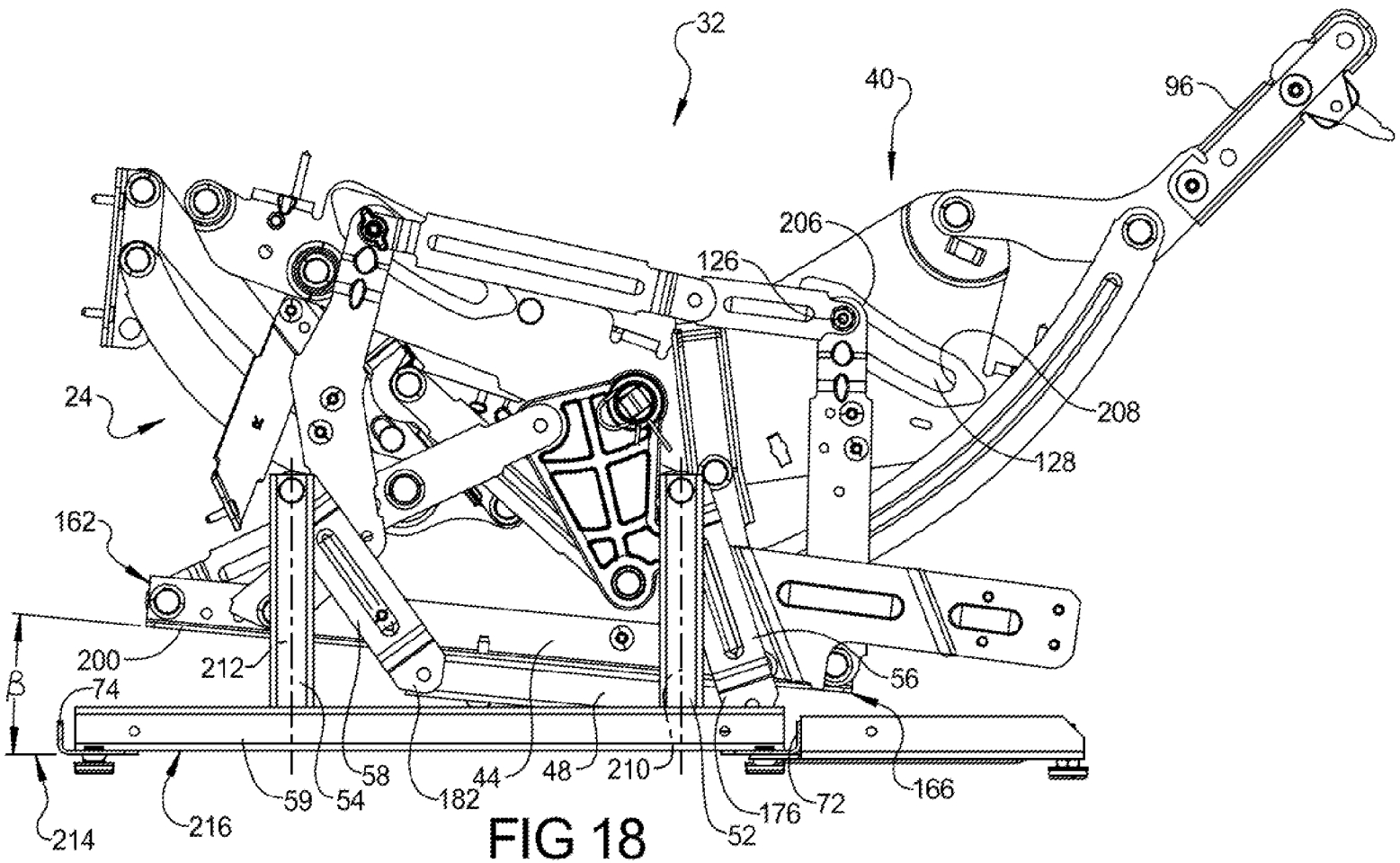
FIG. 18 is the cross sectional elevational view of the mechanism portion of FIG. 16 further shown in the rearward glide position.

Referring to FIG. 18, with leg rest assembly 24 in the fully retracted position and the seat back member represented by right seat back support member 96 in the fully upright position, when actuation mechanism 32 is moved to the rear glide position the rotational fasteners 136, 140 connected to lower link ends 176 and 182 of first and second glide links 56, 58 are individually positioned substantially rearward of first and second longitudinal axes 210, 212 of the respective first and second posts 52, 54. Forward facing end 162 of right side support member 44 is positioned rearward of front cross member 74, and rear facing end of 166 of right side support member 44 is positioned rearward of second longitudinal axis 212. In the rear glide position second flange 200 of right side support member 44 defines an angle beta ($\beta$) with respect to a plane 214 defined by lower surface 216 of first longitudinal frame member 59.

Referring to FIG. 19, when leg rest assembly 24 is in the leg rest release condition, first semi-circular cavity 144 created in first link member 146 of first pantograph linkage set 34 releases from engagement to first engagement pin 148. Thereafter, continued rotation of drive rod 108 can occur (in a clockwise direction as viewed in FIG. 19) which rotates a leg rest lock link 218, which retracts an extension link 220. Extension link 220 is connected by first engagement pin 148 to a connecting link 222. Rotation of leg rest lock link 218 occurs until leg rest lock link 218 is oriented substantially facing a rearward direction "B" with respect to drive rod 108. Once an object 224 which is hindering retraction of leg rest assembly 24 is removed, leg rest assembly 24 can return by gravity toward the leg rest fully retracted position, and engagement pin 148 can be manually re-engaged with first semi-circular cavity 144 for subsequent powered operation of leg rest assembly 24.

Figure 20:
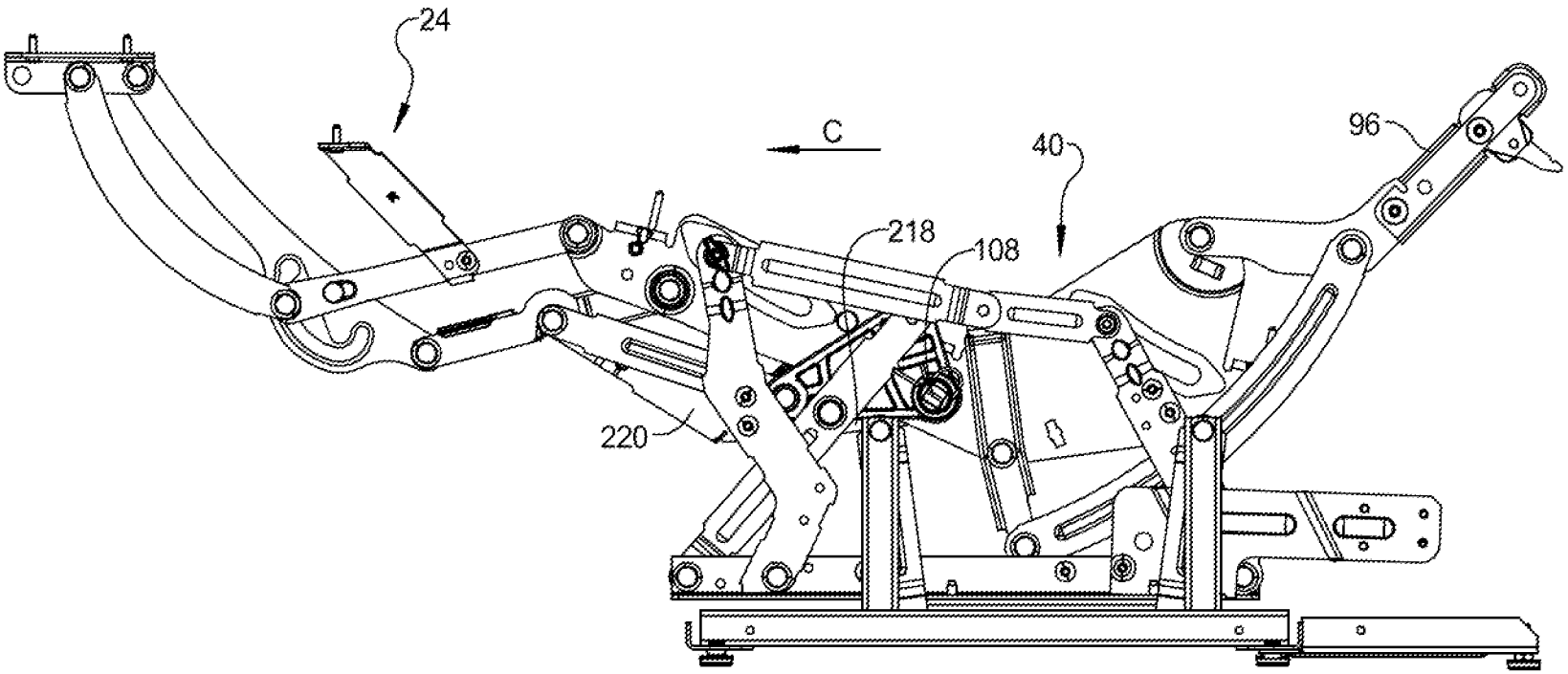
FIG. 20 is the cross sectional elevational view of the mechanism portion of FIG. 16 further showing the leg rest in the fully extended position and the seat back in the fully upright position.

Referring to FIG. 20, to reach the leg rest assembly fully extended position, leg rest assembly 24 is extended in a generally forward direction "C" by rotation and forward displacement of drive rod 108 along cam slot 109 (see FIG. 3 and sequentially in FIGS. 5-13) until leg rest lock link 218 is generally directed in the forward direction "C" with respect to drive rod 108 and extension link 220 directs full forward extension of leg rest assembly 24. Forward and rear glider motions are still permitted with leg rest assembly 24 in the fully extended position.

Figure 21:
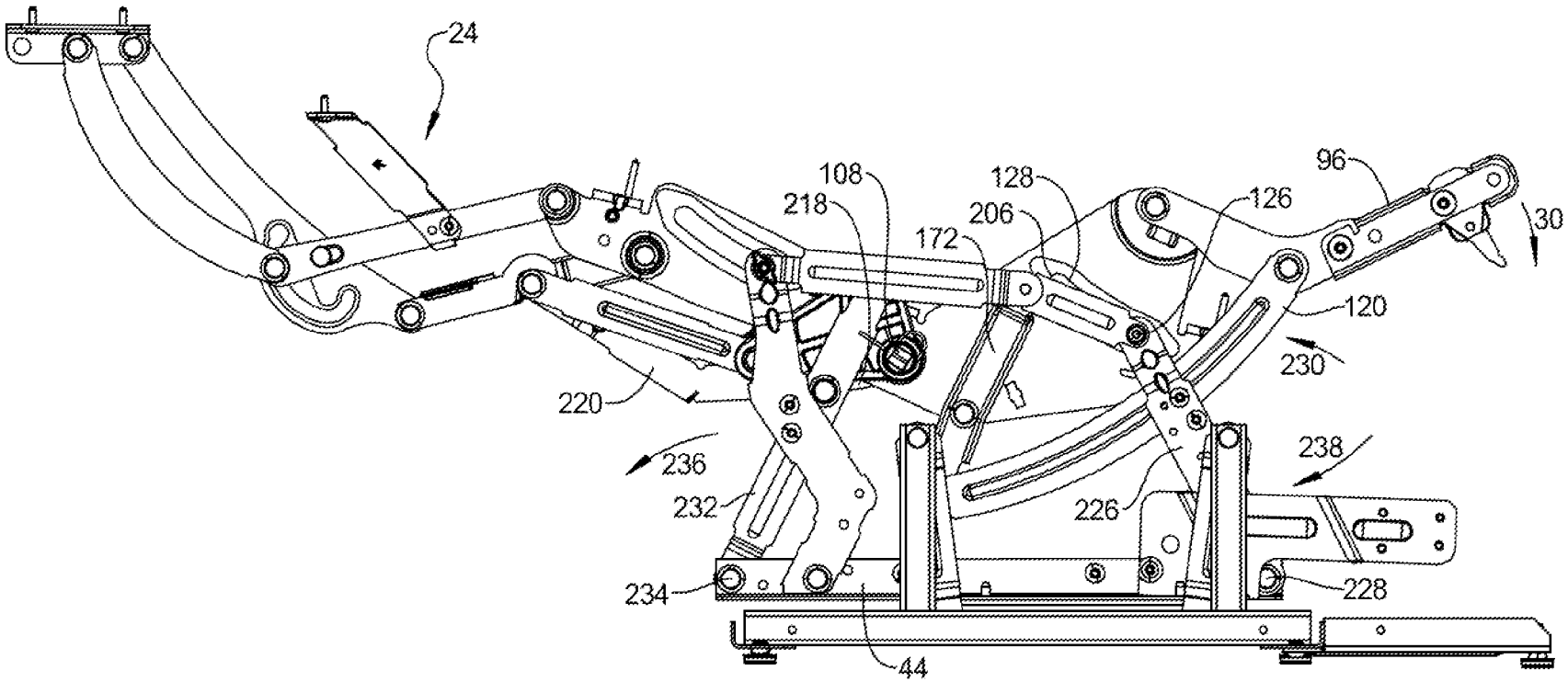
FIG. 21 is the cross sectional elevational view of the mechanism portion of FIG. 16 further showing the leg rest in the fully extended position and the seat back in the fully reclined position.

Referring to FIG. 21, after the fully extended position of leg rest assembly 24 is reached, the seat back member represented by right seat back support member 96 can be rotated from the fully upright to the fully reclined position shown by rotation in the seat back recline arc of rotation 30. Further axial rotation of drive rod 108 stops upon reaching the fully extended position of leg rest assembly 24, thereafter drive rod 108 is further forwardly displaced along cam slot 109 which causes rotation of a second rear support link 226 connected to right side support member 44 by a rotational fastener 228 about an arc of rotation 230. Forward displacement of drive rod 108 along cam slot 109 further causes rotation of a second front support link 232 connected to right side support member 44 by a rotational fastener 234 about an arc of rotation 236. First arc shaped link 120 displaces in an arc of rotation 238 allowing right seat back support member 96 to rotate about arc of rotation 30, which is limited by displacement of first pin 126 away from forward slot end 206 until first pin 126 contacts rear facing slot end 208 of elongated slot 128.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A glider furniture member adapted for electrically powered operation, comprising:

a frame;

an actuation mechanism rotatably suspended from the frame permitting forward and rearward gliding motions of the actuation mechanism, the actuation mechanism including:

a leg rest assembly movable between a fully retracted and a fully extended position inclusive; and a seat back member movable between a fully upright and a fully reclined position inclusive;

an electrically powered drive assembly connected to the actuation mechanism and suspended from the frame permitting the drive assembly together with the actuation mechanism to displace during both the forward and rearward gliding motions, the drive assembly operating to rotate the leg rest assembly and the seat back member independently of an occupant induced force operating to move the actuation mechanism in the forward and rearward gliding motions; and a drive rod directly connected to the drive assembly by first and second drive links and further connected to both the leg rest assembly and the seat back member, the drive rod rotated about a longitudinal axis of the drive rod and forwardly displaced in a cam slot in a direction orthogonal to the longitudinal axis along the cam slot as the leg rest assembly is extended to the leg rest fully extended position, a further forward displacement of the drive rod along the cam slot after the leg rest fully extended position is reached and the rotation of the drive rod about the longitudinal axis of the drive rod stopped causes rotation of the seat back member from the fully upright to the fully reclined position, the forward and rearward glider motions being available with the leg rest assembly in the fully extended position.

2. The glider furniture member of claim 1, further including a plurality of posts fixedly connected to the frame and extending upwardly therefrom, having the actuation mechanism rotatably suspended from pins received at an upper end of individual ones of the plurality of posts.

3. The glider furniture member of claim 2, further including:

a plurality of links individually rotatably connected to one of the pins received in the upper end of the individual ones of the plurality of posts;

wherein the actuation mechanism is rotatably connected to a lower end of individual ones of the plurality of links.

4. The glider furniture member of claim 2, wherein the frame further includes:

first and second longitudinal frame members each having two of the plurality of posts fixedly connected thereto, first and second ones of the posts connected to the first longitudinal frame member and third and fourth ones of the posts connected to the second longitudinal frame member; and a plurality of links, having individual ones of the links rotatably connected to a pin received in an upper end of each of the posts.

5. The glider furniture member of claim 2, wherein the frame further includes:

first and second support structures, the first support structure rotatably connected to first and second ones of the posts, and the second support structure rotatably connected to third and fourth ones of the posts;

wherein the actuation mechanism is rotatably connected to the first and second support structures.

6. The glider furniture member of claim 1, wherein the electrically powered drive assembly further includes an electric motor operating to displace a gear housing.

7. The glider furniture member of claim 6, wherein the gliding motions are available with the actuation mechanism positioned in any of a neutral position having the leg rest assembly in the fully retracted position and the seat back member in the fully upright position, the leg rest in the fully extended position, and the seat back member in the fully reclined position.

8. The glider furniture member of claim 1, wherein the frame includes:

rear and front cross members fixedly connected to first and second longitudinal frame members; and a right frame extension connected to the first longitudinal frame member and a left frame extension connected to the second longitudinal frame member;

wherein each of the first and second longitudinal frame members, the rear and front cross members, and the right and left frame extensions are fixed to each other and immovable with respect to a planar surface during the gliding motions.

9. A glider furniture member adapted for electrically powered operation, comprising:

a frame including a plurality of upright posts;

a plurality of links individually rotatably connected to individual ones of the plurality of upright posts;

an actuation mechanism suspended from the upright posts at rotatably connected free ends of each of the links permitting forward and rearward gliding motions of the actuation mechanism, the actuation mechanism including a leg rest assembly movable between a fully retracted and a fully extended position inclusive;

an electrically powered drive assembly connected to the actuation mechanism and suspended from the frame permitting the drive assembly together with the actuation mechanism to displace during both the forward and rearward gliding motions, the drive assembly operating to rotate the leg rest assembly independently of an occupant induced force operating to move the actuation mechanism in the forward and rearward gliding motions, forward and rearward gliding motion of the actuation mechanism being available with the leg rest assembly in the fully extended position; and a drive rod directly connected to the drive assembly by first and second drive links and further connected to the leg rest assembly, the leg rest assembly moved to the leg rest fully extended position by rotation about a longitudinal axis of the drive rod and forward displacement in and along a cam slot orthogonal to the longitudinal axis of the drive rod.

10. The glider furniture member of claim 9, further including a seat back member connected to the actuation mechanism and movable between a fully upright and a fully reclined position inclusive.

11. The glider furniture member of claim 9, wherein the electrically powered drive assembly connected to the actuation mechanism further operates to rotate the seat back member independently of the occupant induced force operating to move the actuation mechanism in the forward and rearward gliding motions.

12. The glider furniture member of claim 9, wherein rotation of the seat back member away from the fully upright position is sequenced to start after the leg rest assembly reaches the leg rest fully extended position.

13. The glider furniture member of claim 9, further including a plurality of links individually rotatably pinned at an upper end of individual ones of the plurality of upright posts, wherein the actuation mechanism is rotatably connected to a lower end of individual ones of the plurality of links.

14. The glider furniture member of claim 9, further comprising a hinge pin assembly rotatably connecting the drive assembly to the actuation mechanism such that the drive assembly rotates with respect to a longitudinal axis of a hinge pin of the hinge pin assembly, the hinge pin assembly and the drive assembly thereby being co-rotatable with the actuation mechanism during the forward and rearward gliding motions.

15. A glider furniture member adapted for electrically powered operation, comprising:

a frame having two posts connected to each of a first and a second longitudinal frame member and extending upwardly therefrom;

four links, each rotatably connected to one of the posts;

first and second support structures, the first support structure rotatably connected to the links connected to the first longitudinal frame member, and the second support structure rotatably connected to the links connected to the second longitudinal frame member;

an actuation mechanism rotatably connected to the first and second support structures and thereby suspended from the upright posts by the links, permitting forward and rearward gliding motions of the actuation mechanism, the actuation mechanism including:

a leg rest assembly;

a seat back member;

an electrically powered drive assembly suspended from the frame permitting the drive assembly to displace during both the forward and rearward gliding motions, the drive assembly operating to rotate the leg rest assembly and the seat back member independently of an occupant induced force operating to move the actuation mechanism in the forward and rearward gliding motions, forward and rearward gliding motion of the actuation mechanism being available with the leg rest assembly in the fully extended position; and a drive rod directly connected to the drive assembly by first and second drive links and also connected to the leg rest assembly and the seat back member, the leg rest assembly moved to the leg rest fully extended position by rotation about a longitudinal axis of the drive rod and forward displacement in and along a cam slot orthogonal to the longitudinal axis of the drive rod by operation of the drive assembly.

16. The glider furniture member of claim 15, wherein the leg rest assembly is movable between a fully retracted and a fully extended position inclusive by the drive assembly.

17. The glider furniture member of claim 16, wherein the seat back member is movable between a fully upright and a fully reclined position inclusive by the drive assembly, after the leg rest assembly reaches the fully extended position.

18. The glider furniture member of claim 15, wherein the frame further includes a front cross member, a forward facing end of each of the first and second support structures extending forwardly of the front cross member at a cessation of the forward gliding motion.

19. The glider furniture member of claim 15, wherein the frame further includes a rear cross member, a rearward facing end of each of the first and second support structures extending rearwardly of the rear cross member at a cessation of the rearward gliding motion.

* * * * *